US007884295B2

(12) United States Patent
Aoki et al.

(10) Patent No.: US 7,884,295 B2
(45) Date of Patent: Feb. 8, 2011

(54) PUSH BUTTON SWITCH COVER MEMBER

(75) Inventors: Kenji Aoki, Nagano (JP); Mitsutoshi Hiraya, Nagano (JP); Shinji Hotta, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 12/084,706

(22) PCT Filed: Nov. 2, 2006

(86) PCT No.: PCT/JP2006/322018

§ 371 (c)(1),
(2), (4) Date: May 8, 2008

(87) PCT Pub. No.: WO2007/055157

PCT Pub. Date: May 18, 2007

(65) Prior Publication Data

US 2009/0166165 A1 Jul. 2, 2009

(30) Foreign Application Priority Data

Nov. 8, 2005 (JP) ..... 2005-323379

(51) Int. Cl.
*H01H 9/00* (2006.01)

(52) U.S. Cl. ..... 200/314; 200/514

(58) Field of Classification Search ..... 200/341, 200/514, 308, 310, 313, 314, 517; 400/490, 400/491

See application file for complete search history.

(56) References Cited

U.S. PATENT DOCUMENTS 5,677,007 A 10/1997 Tsai
2003/0034241 A1 * 2/2003 Kunthady et al. ..... 200/341
2003/0102204 A1 * 6/2003 Shimizu et al. ..... 200/341

FOREIGN PATENT DOCUMENTS

| | | |
|---|---|---|
| CN | 1106565 | 8/1995 |
| CN | 1185460 | 6/1998 |
| CN | 2622830 | 6/2004 |
| FR | 2 752 536 | 2/1998 |

(Continued)

OTHER PUBLICATIONS

Translation of the Detail Description of JP 09-102240 A.*

(Continued)

*Primary Examiner*—Felix O Figueroa
(74) *Attorney, Agent, or Firm*—Wenderoth, Lind & Ponack, L.L.P.

(57) ABSTRACT

A silicone rubber composition having such selective adhesiveness that shows high adhesion to an organic material than to a molding die is bonded to a sheet of the organic material and is vulcanized and cured in the mold. Thus, an elastomer keypad of double-layer structure is produced in which an organic material layer, which can be easily subjected to coating, bonding with an adhesive or pressure-sensitive adhesive, or the like, has been united and bonded as a surface layer to the rubber. Keytops are bonded to the elastomer keypad to produce a covering member for push-button switches. A polyurethane elastomer sheet is preferably used as the organic material.

9 Claims, 23 Drawing Sheets

FOREIGN PATENT DOCUMENTS

| | | |
|---|---|---|
| JP | 59-152637 | 10/1984 |
| JP | 59-173948 | 11/1984 |
| JP | 61-117426 | 7/1986 |
| JP | 5-174658 | 7/1993 |
| JP | 6-309988 | 11/1994 |
| JP | 7-296676 | 11/1995 |
| JP | 8-118417 | 5/1996 |
| JP | 8-253607 | 10/1996 |
| JP | 9-102240 | 4/1997 |
| JP | 9-212271 | 8/1997 |
| JP | 11-227257 | 8/1999 |
| JP | 2004-164946 | 6/2004 |
| JP | 2004-186055 | 7/2004 |
| JP | 2004-227867 | 8/2004 |
| JP | 2004-303493 | 10/2004 |
| JP | 2005-209543 | 8/2005 |
| JP | 2005-251514 | 9/2005 |

OTHER PUBLICATIONS

International Search Report issued Dec. 5, 2006 in International (PCT) Application No. PCT/JP2006/322018.

Notification of Transmittal of Translation of the International Preliminary Report on Patentability issued May 22, 2008 in International Application No. PCT/JP2006/322018.

Supplementary European Search Report issued Feb. 3, 2010 in corresponding European Patent Application No. 06822936.8.

European Search Opinion dated Feb. 3, 2010 in corresponding European patent Application No. 06822936.

European Office Action issued Sep. 30, 2010 in corresponding European Application No. 06822936.8.

* cited by examiner

PUSH BUTTON SWITCH COVER MEMBER

BACKGROUND OF THE INVENTION

I. Technical Field

The present invention relates to a push-button switch cover member used for a push-button switching operation portion of a mobile computer such as cell-phone, personal digital assistant (PDA).

II. Related Art

In mobile computers, downsizing, especially reducing the thickness of key units has been desired so that a push-button switch cover member in which a number of keys (push buttons) used for switching operation are gathered in place and arranged on one keypad sheet made of rubber or elastomeric material. Such a push-button switch cover member can be assembled easily and leads to a decrease in the number of parts, so that the cover member having various functions and designs is now commonly used instead of a conventional mechanical switch.

In the push-button switch cover member, transparency or translucency is required in addition to the other functions such as electric insulation, heat resistance, low-temperature resistance, repetitive bondability, rebound resilience, because the cover member is backlit using a light source such as LED for improving operability of the mobile computer in a dark place, and that silicone rubber having excellent properties in such functions and transparency is now preferably used.

Furthermore, the mobile computer should have a good appearance and design to meet personal preference. Accordingly, in addition to these functions, a push-button switch cover member should have various designs on the keytop portion to cope with various preferences of users. However, silicone rubber has a poor chemical reactivity so that its surface should be treated by plasma treatment or priming with a coupling agent before applying a coating layer or adhering a keytop member made of another material onto its surface (For example, refer to Japanese Patent Publication No. H 7-296676 A and Japanese Patent Publication No. H 8-253607 A.

SUMMARY OF THE INVENTION

However, in the invention described in Japanese Patent Publication No. H 7-296676 A and Japanese Patent Publication No. H 8-253607, pretreatment such as low temperature plasma treatment or priming is needed previously when a coating layer is applied on the keytop portion of the push-button switch cover member made of silicone rubber. Accordingly additional facilities and processing steps had been required. Also, when various designs are to be made on the keytop portion by such as an ink, cost is increasing and the processing becomes complex.

In light of such inconveniences mentioned above, the present invention is aimed to solve the above mentioned problems and to provide a push-button switch cover member having a double-layered elastic keypad to which a keytop member made of material other than that of the double-layered elastic keypad can be fixed easily even when the above pretreatment processes are skipped. The problem to be solved in the present invention is to obtain a push-button switch cover member that can be provided through the following processes:

by firstly kneading and sheeting a millable silicone rubber composition having such selective adhesiveness that the silicone rubber composition adheres stronger to an organic resin sheet than to a molding die and then curing the silicone rubber composition in the molding die, or by applying or injection-molding a liquid silicone rubber composition, having such selective adhesiveness that the silicone rubber composition adheres stronger to an organic resin than to a molding die, on an organic resin sheet and then curing the liquid silicone rubber under pressure. Thus obtaining the double-layered elastic keypad to which a keytop made of material other than that of the keytop can be easily adhered.

The problems of the present invention can be solved by a first aspect of the present invention in which a push-button switch cover member which comprises:

a push-button switch cover member comprising:

a double-layered elastic keypad comprising a silicone rubber layer and an organic resin layer excellent in adhesiveness to an organic material; and a single keytop or multiple keytops attached to the elastic keypad.

The elastic keypad has the organic resin layer on an upper side thereof, and the silicone rubber layer on a lower side thereof and a pushing projection for pressing a contact portion is provided on a backside of the silicone rubber layer at a position corresponding to a mounting portion on which the keytop is mounted.

The silicone rubber layer is formed of a silicone rubber composition having such selective adhesiveness that the silicone rubber composition adheres stronger to the organic resin layer than to a molding die and the organic resin layer and the silicone rubber layer are firmly adhered together in one body.

The organic materials of the present invention are organic sticking agents or adhesives such as an acrylic sticking agent, a cyanoacrylate adhesive, a printed layer (binder ink).

A second aspect of the push-button switch cover member is characterized in that in addition to the first aspect, the organic resin layer is a polyurethane elastomer layer.

A third aspect of the push-button switch cover member is characterized in that in addition to the second aspect, a previously cut and shaped polyurethane elastomer sheet is adhered tightly to the silicone rubber layer at the same time when the silicone rubber layer is cured.

A fourth aspect of the push-button switch cover member is characterized in that in addition to the first aspect, the silicone rubber composition comprises 100 parts by weight of an addition reactive organopolysiloxane composition, 1 to 100 parts by weight of a reinforcing fine silica powder and 0.1 to 50 parts by weight of an organic compound or an organosilicone compound having epoxy equivalent of 100 to 5000 g/1 mol and at least one aromatic ring.

A fifth aspect of the push-button switch cover member is characterized in that in addition to the first aspect, the silicone rubber is a millable or a liquid silicone rubber composition.

A sixth aspect of the push-button switch cover member is characterized in that in addition to the first aspect, the single keytop or the multiple keytops are adhered and fixed, through an adhesive, to a predetermined position on the top side surface of the elastic keypad.

A seventh aspect of the push-button switch cover member is characterized in that in addition to the sixth aspect, the adhesive is a double-stick tape, a cyanoacrylate base adhesive or a binder ink.

An eighth aspect of the push-button switch cover member is characterized in that in addition to the first aspect, the keytop is formed of a transparent resin, and a top surface of the keytop is coated or a rear surface thereof is printed.

A ninth aspect of the push-button switch cover member is characterized in that in addition to the first aspect, the rear surface of the single keytop or multiple keytops is printed by a binder ink and is adhered and fixed, through binder ink, to a predetermined position on the top surface of the elastic keypad.

A tenth aspect of the push-button switch cover member is characterized in that in addition to any one of the first to ninth aspects, the multiple keytops are formed on a planar keytop sheet or a composite type molded keytop sheet.

An eleventh aspect of the push-button switch cover member is characterized in that in addition to the tenth aspect, the keytop sheet is formed of resin or metal.

A twelfth aspect of the push-button switch cover member is characterized in that in addition to the second or third aspect, the polyurethane elastomer layer has a thickness of 0.01 mm to 0.5 mm.

According to the first aspect of the push-button switch cover member, the top layer of the elastic keypad is made of an organic resin having an excellent adhesiveness to an organic material, so that coating and adhesion of the keytop made of material other than that of the organic resin layer can be easily completed without any pretreatment. In addition, the pushing projection for pressing the contact portion is provided at a position corresponding to the keytop, so that on/off switching operation can be surely conducted. Further, the silicone rubber layer and the organic resin layer excellent in adhesiveness to the organic material are adhered together in one body, and also the organic resin layer and the keytop are adhered together in one body directly or through adhesive. Therefore, the push-button switch cover member which has a low tendency to cause coming off of the keytop from the organic resin layer even when the cover member is subjected to a repeated bending test, can be provided.

According to the second aspect of the push-button switch cover member, the organic resin layer on the side of the top surface is the polyurethane elastomer layer which is excellent in adhesiveness to material other than the polyurethane elastomer, so that the cover member, in which coating or fixing of the keytop made of other material by adhesion or sticking is easily carried out, can be provided. Conventionally, a cyanoacrylate base adhesive or a light curing adhesive has been used for adhesion between the polycarbonate keytop and the silicone rubber. However, when a conventional silicone rubber, which is poor in adhesiveness, is used as an adherend, a process such as aftercuring, modification of silicone rubber by exposure to ultra violet radiation or application of an amino-base silane coupling agent on the surface of the silicone rubber as a primer, was required. However, in the present invention where polyurethane elastomer is used as an adherend, polyurethane elastomer itself is excellent in adhesiveness to other material so that sufficient adhesiveness between the polyurethane elastomer and the keytop can be carried out using such as cyanoacrylate base adhesives without using the above mentioned pretreatment.

Further, polyurethane elastomer has an excellent tearing strength and elongation property. When polyurethane is laminated on silicone rubber, the resulting laminated sheet shows good shape recoverability after the repeated pressing test, and strong resistance to breakage, so that it can be used when the laminated sheet has a thickness thinner than that of the sheet made only of silicone rubber, which can not be practically used. In a conventional keypad formed only of silicone rubber, 0.2 mm thickness was a lower limit in production, but in the keypad of the present invention having a double-layered structure of polyurethane elastomer and silicone rubber layers, a thickness of 0.1 mm can be produced.

According to the third aspect of the push-button switch cover member, the polyurethane elastomer layer is formed at first by previously shaping a polyurethane elastomer sheet and then by firmly adhering the polyurethane elastomer sheet to a silicone rubber layer in one body at the time when the silicone rubber layer is cured. Accordingly, a polyurethane elastomer sheet is only adhered to a silicone rubber composition sheet formed by sheeting. The lamination can be carried out by only making a silicone rubber composition sheet formed by sheeting adhere to a desired polyurethane elastomer sheet. Therefore, preparation processes or coating facilities conventionally needed for forming the urethane layer are no longer needed. It is not necessary to control the thickness of the urethane layer at the time of production and any color can be laid on using a colored polyurethane elastomer sheet. Generally, in a coating process, materials for coating are not used efficiently and solvent tends to vaporize into the air, deteriorating the working environment. However, if polyurethane elastomer sheet is bonded and cut out, the amounts of waste material can be minimized. And the push-button switch cover member can be produced without using facilities for ventilation and recovery of the vaporized solvent and there is no fear of environmental deterioration.

According to the fourth aspect of the push-button switch cover member, the silicone rubber layer is made from a silicone rubber composition which comprises 100 parts by weight of an addition reaction-curable organopolysiloxane composition, 1 to 100 parts by weight of a reinforcing silica fine powder, and 0.1 to 50 parts by weight of an organic silicon compound or an organic compound having an epoxy equivalent of 100 to 5000 g/mol and at least one aromatic ring, so that the silicone rubber composition shows poor adhesiveness to chromium which is a material used for surface treatment of the molding die but excellent in adhesiveness to the polyurethane elastomer. Accordingly, as there is no need for mold release treatment, molding workability can be improved, and in the push-button switch cover member, the silicone rubber layer and the polyurethane elastomer layer can be firmly attached together into one body.

According to the fifth aspect of the push-button switch cover member, the silicone rubber is made of a millable silicone rubber composition or a liquid silicone rubber composition, and when the millable silicone rubber composition is used, the silicone rubber composition is firstly formed into a sheet-like shape through, for example, a sheeting process and next the organic resin sheet is placed on the sheet-like silicone rubber composition and then they are set into a compression molding die, and lastly heated under the pressure to firmly adhere them together in one body. In addition, when a liquid silicone rubber composition is used instead of the silicone rubber, the organic resin sheet is previously placed in the molding die and then the liquid silicone rubber composition is injection-molded, or the liquid silicone rubber composition is applied to the organic resin layer and then compression molded, to thereby attach the two layers firmly together in one body.

According to the sixth aspect of the push-button switch cover member, the single keytop or multiple keytops are firmly adhered through adhesive to a predetermined position on the top surface of the elastic keypad, so that in the case where a desired resin keytops are previously prepared, a push-button switch cover member having keytops with various designs can be provided easily.

According to the seventh aspect of the push-button switch cover member, the adhesive is a two-sided sticky tape, a cyanoacrylate adhesive or a binder ink, so that in addition to the sixth aspect, when the double-stick tape is used, the keytop is stuck and fixed only by double-stick tape. Therefore, even if a defective good caused by misalignment of the keytop from its normal position is produced, the position of the keytop can be adjusted by removing and reattaching the keytop, so that the amount of defective products can be reduced more effectively than in a process where keytops are printed or adhered using a cyanoacrylate adhesive. On the contrary, when cyanoacrylate adhesive is used, adhesive reliability can be improved but the above mentioned advantages in the case of using double-stick tape can not be expected. When a binder ink is used, a thin-model push-button switch cover member can be produced. A binder-ink layer formed on the keytop serves as an adhesive layer so that an additional adhesive layer or an adhesive such as the double-stick tape or a cyanoacrylate adhesive, is no longer needed. When a thermoplastic binder ink is used as the binder ink, the change in adhesive property thereof with time during storage after it is coated on an adherend varies slowly, and the time period between the coating step and adhering step to the other adherend can be set longer. Therefore, mass productivity can be improved without caring the change of the adhesive property after the thermoplastic binder ink is coated on the adherend.

According to the eighth aspect of the push-button switch cover member, the keytop is formed of a transparent resin and the upper surface of the keytop is coated or the lower surface of the keytop is printed, so that in addition to the first aspect, a printed character or letter and/or a picture etc. is illuminated by a light through a transparent keytop from a light source and an operator of the keytop can easily read, in the dark, the character and/or picture etc. on the keytop. When the surface of the keytop is coated, a desired character and/or numeric character can be shaped by eliminating the coated layer using such as laser to form a decorative layer on the keytop surface. Therefore the entire lower surface of the keytop can be used as an adhering surface to the elastic keypad.

According to the ninth aspect of the push-button switch cover member, the lower surface of the single keytop or multiple keytops are printed with a binder ink and adhered and fixed to the predetermined position on the top surface of the elastic keypad, so that in addition to the first aspect, a thin-model push-button switch cover member can be produced without using other adhesive layer such as the double-stick tape or a cyanoacrylate adhesive because an adhesive printed layer (or binder ink) is formed on the keytop. In particular, when a thermoplastic binder ink is used, the change in adhesive property thereof with time during storage after it is printed on an adherend, varies slowly, so that the time period between the printing step and the adhering step to the other adherend can be set longer. Therefore, mass productivity can be improved without caring about the change in the adhesive property after the binder ink is coated.

According to the tenth aspect of the push-button switch cover member, the multiple keytops are shaped into a plain sheet type or composite molded type keytop sheet, so that in addition to any one of aspects from the first to ninth, every keytop is connected to the keytop sheet. Therefore, the keytops are really easy to handle and the process of adhering the keytop sheet to the keypad can be streamlined. When the binder ink is previously applied to the keytop sheet, the three members—the keytop sheet, the organic resin sheet and the silicone rubber—can be easily molded into one body.

According to the eleventh aspect of the push-button switch cover member, the keytop sheet is made of resin or metal, so that in addition to the tenth aspect, when the keytop is made from a resin-made keytop sheet, warp of the resulting push-button switch cover member can be suppressed by the rigidity of the resin sheet when the resin-made keytop sheet has a thickness not thinner than 0.2 mm, preferably not thinner than 0.4 mm where contribution to the rigidity appears. When the keytop is made from a metal-made keytop sheet, warp of the push-button switch cover member can be suppressed alike by the rigidity of metal.

According to the twelfth aspect of the push-button switch cover member, the polyurethane elastomer layer has a thickness of 0.01 mm to 0.5 mm, so that in addition to the effects of the second or third aspect, the polyurethane elastomer sheet has an excellent followability to the movement of the silicone rubber layer. There is no fear of peeling of the polyurethane elastomer even at the time when the cover member is subjected to a repeated bending test. In addition, polyurethane elastomer has a problem of yellowing but yellowing can hardly be recognized due to the decreased thickness.

BRIEF DESCRIPTION OF THE DRAWINGS

FIG. 6 is made of a transparent film or a sheet-like keytop material.

DESCRIPTION OF THE INVENTION

Preferred embodiments of the present invention will be described hereunder.

Figure 1:
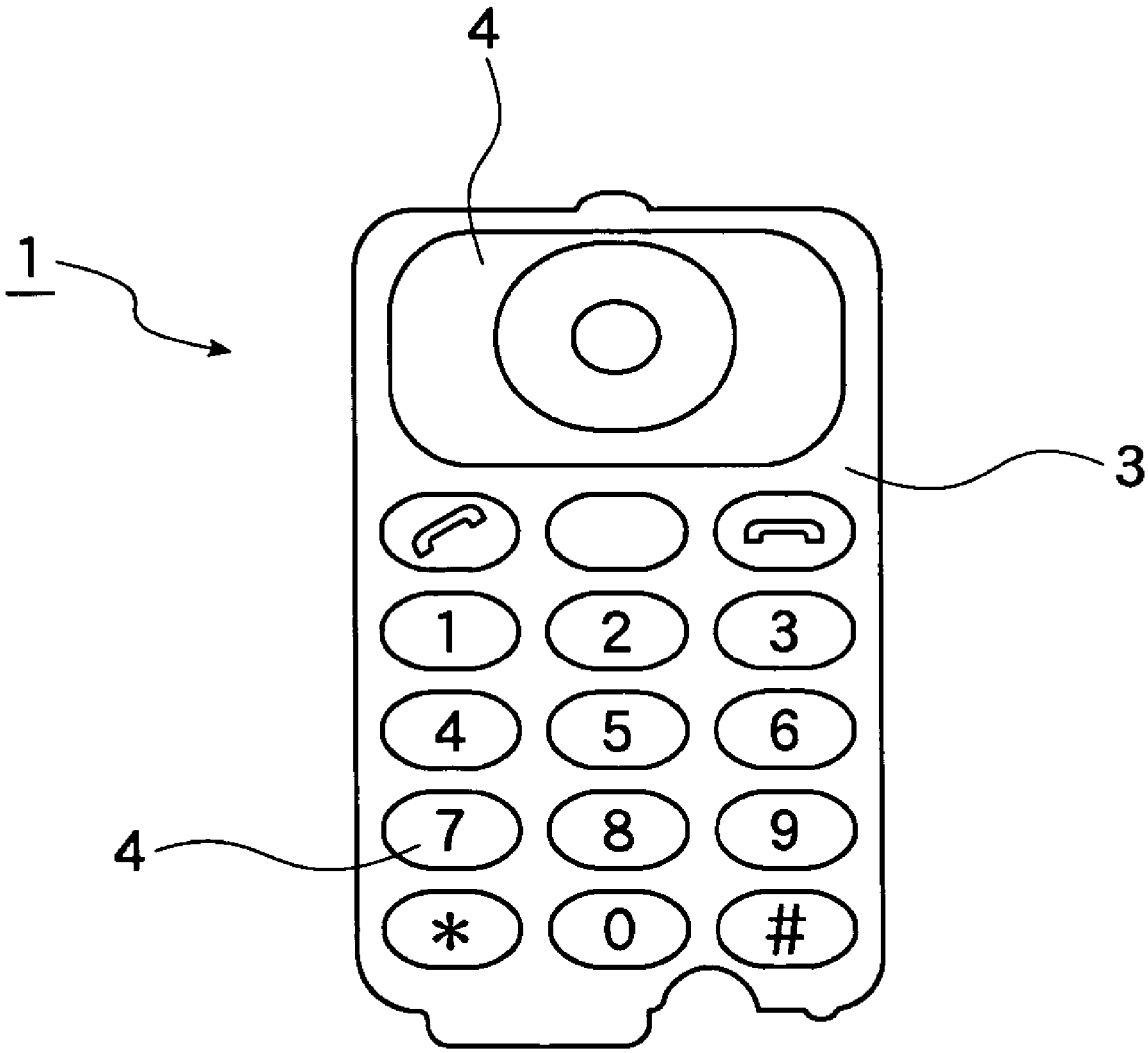
FIG. 1 is a front view of a push-button switch cover member 1 of the present invention.
Figure 2:
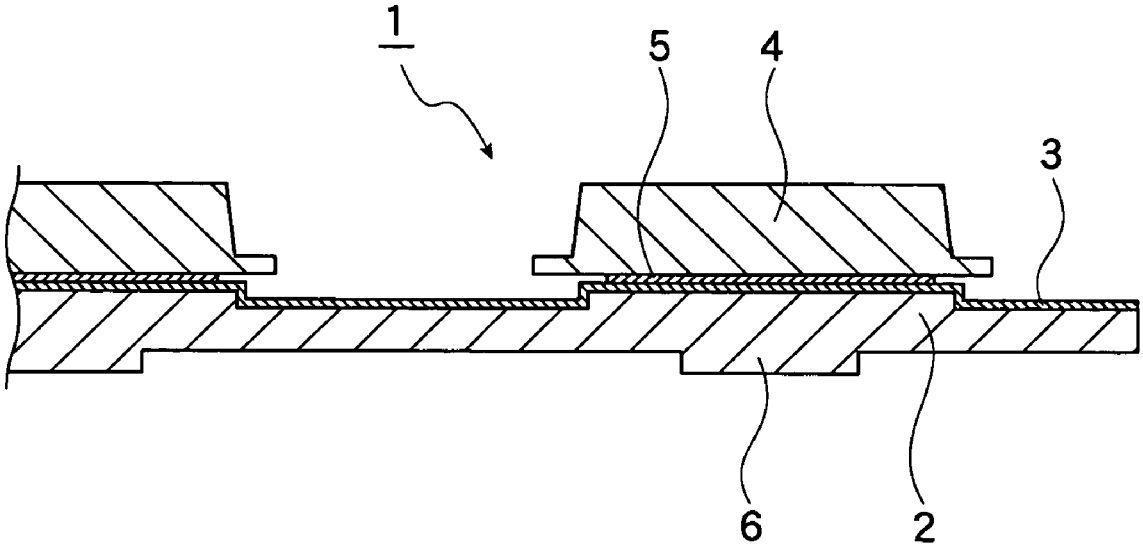
FIG. 2 is a longitudinal sectional view seen in the cross-sectional direction taken along a line passing through the keytop 4 of FIG. 1.

FIG. 1 is a front view showing one of the embodiments of the push-button switch cover member 1 of the present invention and FIG. 2 is a cross sectional view seen from the cross-sectional direction after cutting it along a line passing through a keytop 4 of FIG. 1.

In the present push-button switch cover member 1, the keytop 4 is fixed using adhesive or a double-stick tape 5, to the top surface of an organic resin layer (preferably a polyurethane elastomer layer) 3 which is firmly attached together in one body with a silicone rubber layer 2. Here, the wordings of "firmly attached in one body" means that they are firmly attached together so that no peeling or detachment will be observed between them even if it is actually served as a push-button switch cover member, not that they are merely attached together.

A silicone rubber composition having selective adhesiveness which adheres stronger to the polyurethane elastomer than to a molding die used for molding the silicone rubber layer 2 comprises: (1) an alkenyl-group containing addition reaction-curable organopolysiloxane such as a vinyl group containing dimethyl silicone raw rubber, vinyl-group containing phenyl silicone raw rubber, vinyl group containing fluorosilicone raw rubber etc., (2) a reinforcing silica filler such as an aerosol silica, a precipitated silica, (3) a cross-linking agent for an addition reaction, and a catalyst for addition reaction, and (4) an adhesive improving component. If necessary, a catalytic activity-retarding agent may be added to control the curing time.

As the curing agent for an addition reaction used for curing process, an organohydrogen polysiloxane having at least 2 SiH groups per molecule can be used. This organohydrogen polysiloxane can be linear, cyclic or branched structure and a known organohydrogen polysiloxane can be used as curing agent for an addition reaction-curable silicone rubber composition. A mixing amount of the organohydrogen polysiloxane is preferably between 0.01 and 20 parts by weight based on 100 parts by weight of the alkeynyl group containing organopolysiloxane. Further, when organic peroxide is used as a curing promoter, physical properties such as rubber strength or distortion resistance can be improved. And benzoylperoxide, bis-2,4-dichlorobenzoyl peroxide, dicumylperoxide, di-t-butylperoxide, 2,5-dimethyl-2,5-bis(t-butylperoxi) hexane are examples of organoperoxide. Furthermore, non-reinforcing silica may be further added to adjust the hardness or improve heat resistance.

Further, to the silicone rubber composition which is cured by the addition reaction, preferably a well known reaction retarder for controlling catalytic activity of platinum catalyst such as methyl vinyl cyclotetrasiloxane, acetylene alcohols, siloxane modified acetylene alcohol, hydroperoxide is added. When curing is completed in too short time, only silicone rubber is cured while adhesiveness between the polyurethane elastomer sheet and the silicone rubber remains insufficient. This phenomenon can be prevented by adding a reaction retarder for suppressing catalytic activity of platinum catalyst.

Any well-known catalyst for the addition reaction can be used. More precisely, platinum group metal itself and its compound can be used. For example, fine particle silver, platinic chloride, chloroplatinic acid, chloroplatinic acid 6 monohydrate, complexes of chloroplatinic acid 6 monohydrate, and olefin or divinyl dimethyl polysiloxane, platinic catalyst such as alcohol solution of chloroplatinic acid 6 monohydrate, paradium catalysts, rhodium catalysts are exemplified. These catalysts are preferably used in catalytic amounts. Usually, 1 to 1000 ppm, preferably 10 to 500 ppm in terms of platinum group metal is used. When such metal is added in less than 1 ppm, crosslinking reaction is not fully accelerated, resulting in insufficient curing condition and when used in more than 1000 ppm, reactivity is not so much accelerated with respect to the amount of catalyst added, being uneconomical.

As an adhesive enhancing agent, which is added to the alkenyl group-containing addition reaction-curable organo polysiloxane composition for obtaining an addition reaction-curable silicone rubber composition having a selective adhesiveness stronger to a polyurethane elastomer than to a molding die, (1) an organosilicon compound having at least one Si—H group and at least one adhesiveness-giving functional groups selected from the group consisting of alkoxysilyl group, glycidyl group and acid anhydride;

(2) an organosilicone compound having at least one Si—H bond and at least one aromatic ring, or at least one alkeynyl group and at least one aromatic ring (3) a glycidylized organosilicon compound having an epoxy equivalent of 100 to 5000 g/1 mol, at least one aromatic ring and at least one Si—H bond, are exemplified (see Japanese Patent Publication H6-171021, H8-216273 and 2002-201454).

When the silicone rubber composition including adhesive enhancing component mentioned above is molded in a molding die, the resulting molded article tends to undesirably adhere to the molding die. Therefore, a glycidylized organic silicone compound having an epoxy equivalent of 100 to 5000 g/1 mol, at least one aromatic ring and at least one Si—H bonding is preferably used as an adhesive-giving component which gives an excellent adhesiveness to the adherend, polyurethane elastomer sheet, but poor adhesiveness to chrome plate which is commonly used for surface treatment for a molding die.

The addition cure type silicone rubber composition having selective adhesiveness stronger to polyurethane elastomer than to the molding die can be obtained by homogeneously mixing and kneading the abovementioned components using a rubber-kneader such as a two-roll mill, a Banbury mixer and a kneader.

An elastic keypad in which the polyurethane elastomer layer 3 and the silicone rubber layer 2 are firmly attached in one body can be obtained through a curing process in the molding die after the sheet-like millable silicone rubber composition which is shaped by sheeting process is placed on a polyurethane elastomer sheet. The same elastic keypad can also be obtained through an in mold-injection molding in which the polyurethane elastomer sheet itself is at first placed in the molding die and then previously prepared liquid addition-reactive silicone rubber having selective adhesiveness is injection-molded into the molding die. The silicone rubber composition sheet and the polyurethane elastomer sheet may be formed into a predetermined shape by cutting after they are placed on the other sheet or placed on the other sheet after they are cut into a predetermined shape.

One example of the liquid addition-reactive silicone rubber composition having a selective adhesiveness which is subjected to an inmold injection molding is formulated by blending 100 parts by weight of dimethyl siloxane polymer having a viscosity of 10000 centipoise at a temperature of 25° C. and both terminal groups being blocked by dimethylvinylsilyl group, 40 parts by weight of aerosol silica having a specific surface area of 300 cm2/g, 8 parts by weight of hexamethyl disilazane and 1 part by weight of water for 1 hour at room temperature using a kneader, the temperature is risen up to 150° C. and kneading is continued for 2 hours. Then the blended mixture is cooled down to the room temperature. Into the blended mixture, 20 parts by weight of the dimethyl siloxane polymer, 3 parts by weight of methyl hydrogen polysiloxane having a viscosity of about 10 centipoises at 25° C., 4 parts by weight of glycidylized organic silicone compound with an epoxy equivalent of about 500 g/1 mol having at least one aromatic ring and at least one Si—H bond, are added. Further, 0.1 parts by weight of acetylene alcohol and platinum-vinylsiloxane complex (50 ppm in terms of platinum atom) for extending a shelf time at room temperature, are added and mixed uniformly. A liquid addition-reactive silicone rubber composition having selective adhesiveness can be obtained by adding a selective adhesiveness-giving component thereto.

As an organic resin excellent in adhesiveness to an organic type material, a resin or a plural kinds of resin or elastomer such as polycarbonate, acrylic resin, ABS, AS, polystylene, polyurethane, polyvinyl chloride or elastomers which shows excellent stickiness and adhesiveness to, for example, a sticking agent or an adhering agent can be exemplified. Among those materials, polyurethane elastomer excellent in such properties as elongation, tearing strength, flexibility and low temperature resistance can be preferably used.

As the polyurethane elastomer for use in the present invention, either a polyether polyurethane elastomer obtained by reacting a difunctional polyether such as PPG or PTMG with a diisocyanate, or polyester polyurethane elastomer obtained by polyaddition reaction between adipate and diisocyanate, can be used. In terms of sheetability, any urethane elastomers can be used. Casting- or millable-heat-curing type urethane can be used, and injection-moldable thermoplastic urethane (TPU) can also be used in the present invention.

In order to reduce the variation of the shape of integral-molded silicone rubber, it is desired that polyurethane elastomer should be formed into a sheet having a uniform thickness.

The keytop of the present invention is preferably formed of resin or metal. When translucent material is used, the decorated figures or characters depicted on the top or bottom surface of the keytop can be clearly identified by the lighting from the inner portion of the push-button switch cover member. On the other hand, when a light impermeable material is used, the decorated figures can also be clearly identified because the lighting from the inner portion of the push-button switch cover member passes through the decorated figures such as outlined characters and numerical characters which are outlined by etching or laser machining etc.

Figure 6:
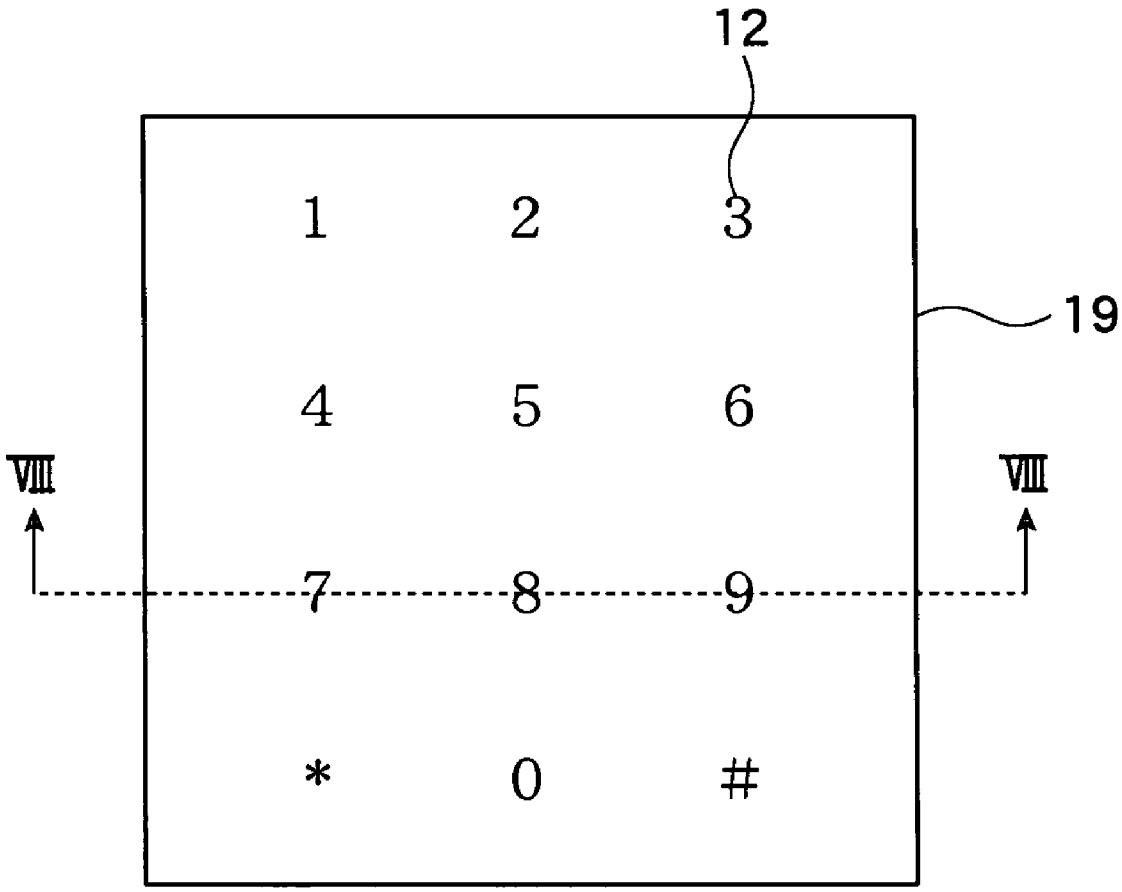
FIG. 6 is a front view of a film- or sheet-like keytop material made of resin or metal with a character printed thereon.
Figure 7:
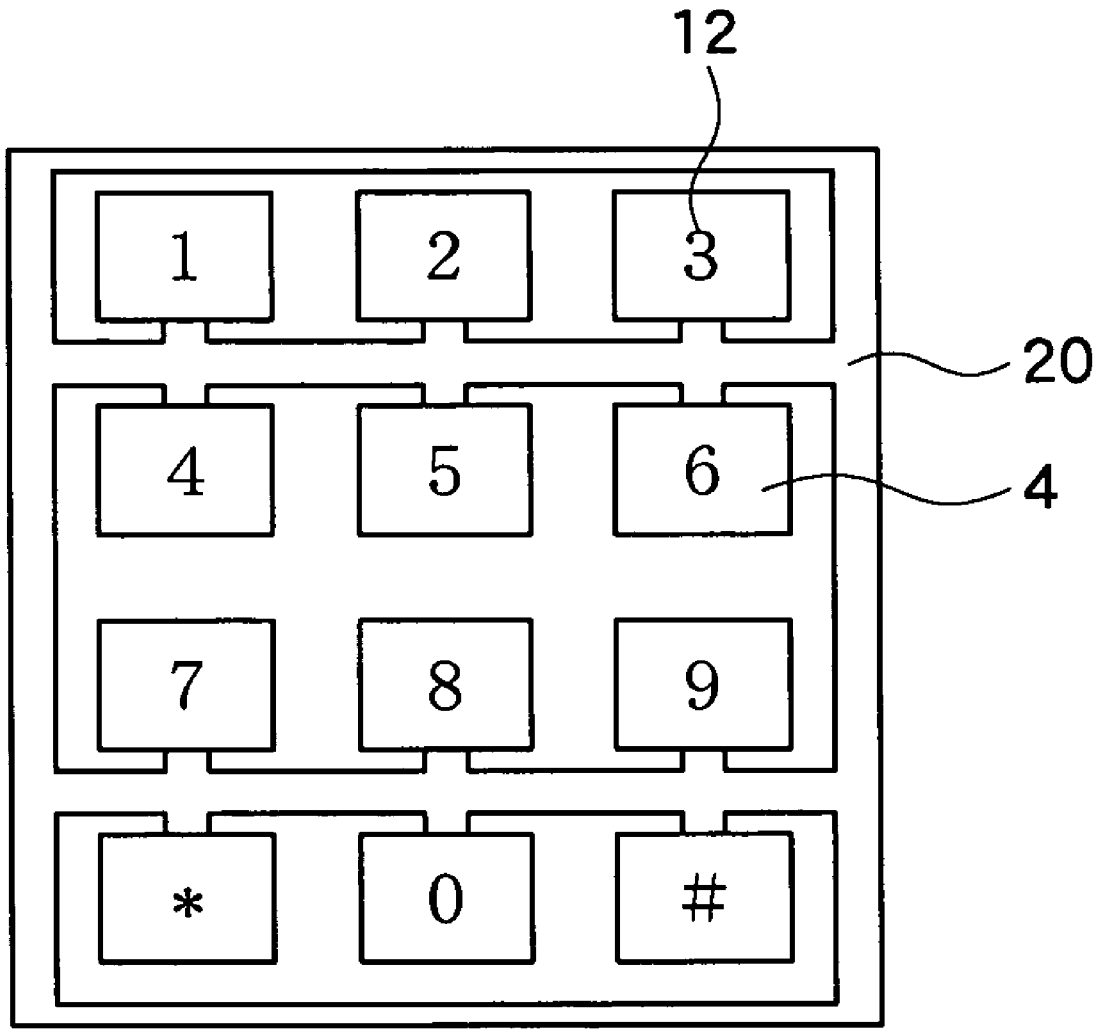
FIG. 7 is a front view of an injection-molded product from which each keytop with a character mark printed thereon, is not yet separated.
Figure 9A:
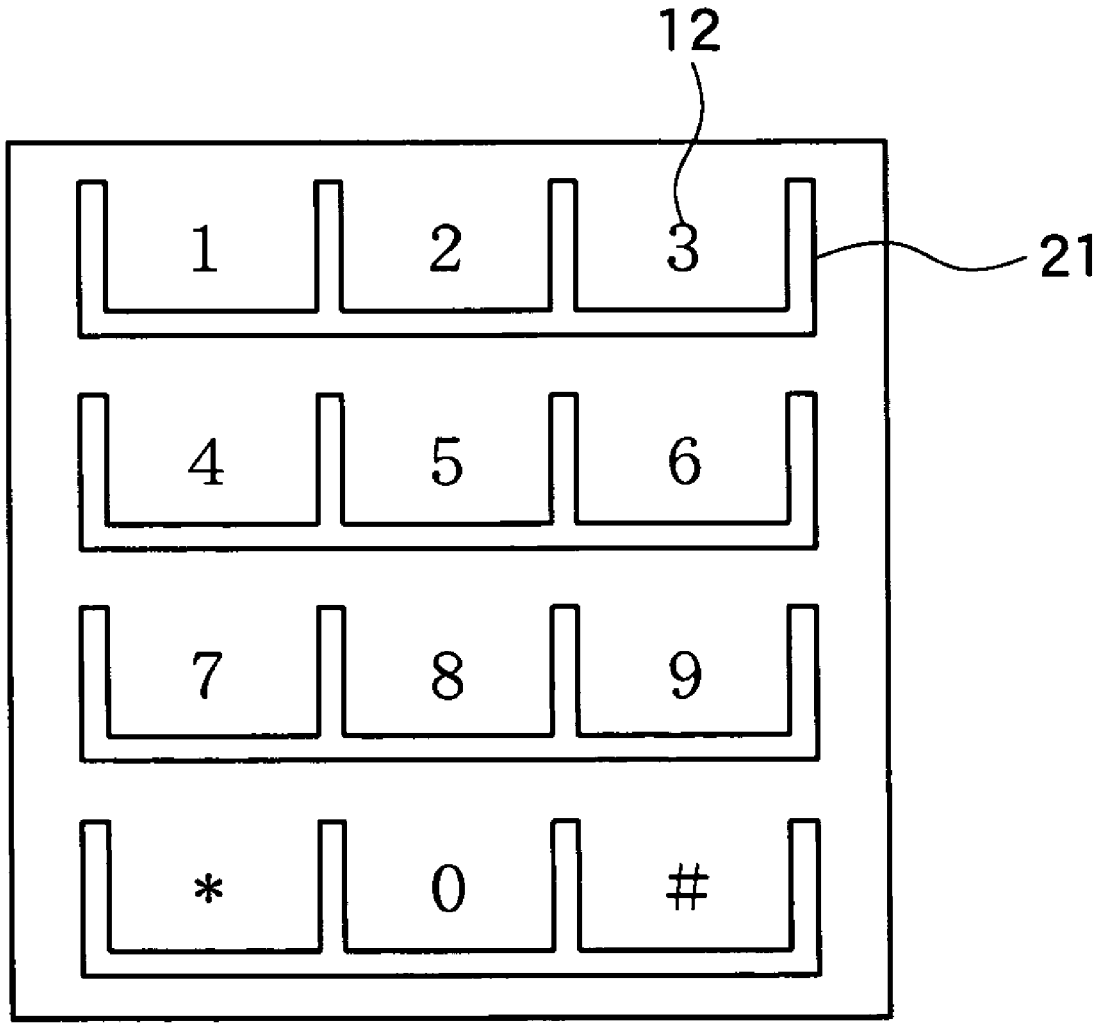
FIG. 9A is a front view of a sheet-like keytop formed from a film- or sheet-like keytop material as shown in FIG. 9B by punching out its outline and then subjected to a slit processing.
Figure 9B:
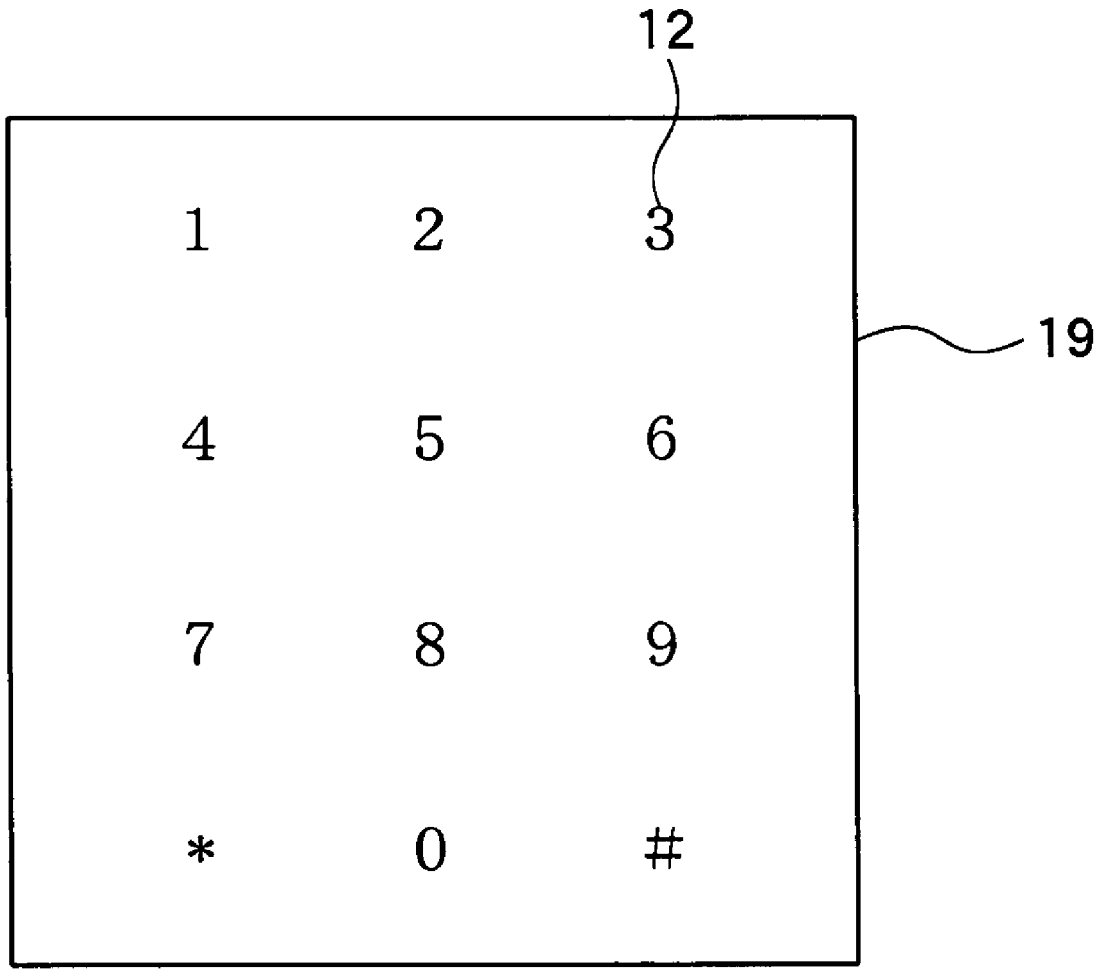
FIG. 9B is a front view of a film- or sheet-like keytop material made of resin or metal with characters printed thereon.
Figure 10A:
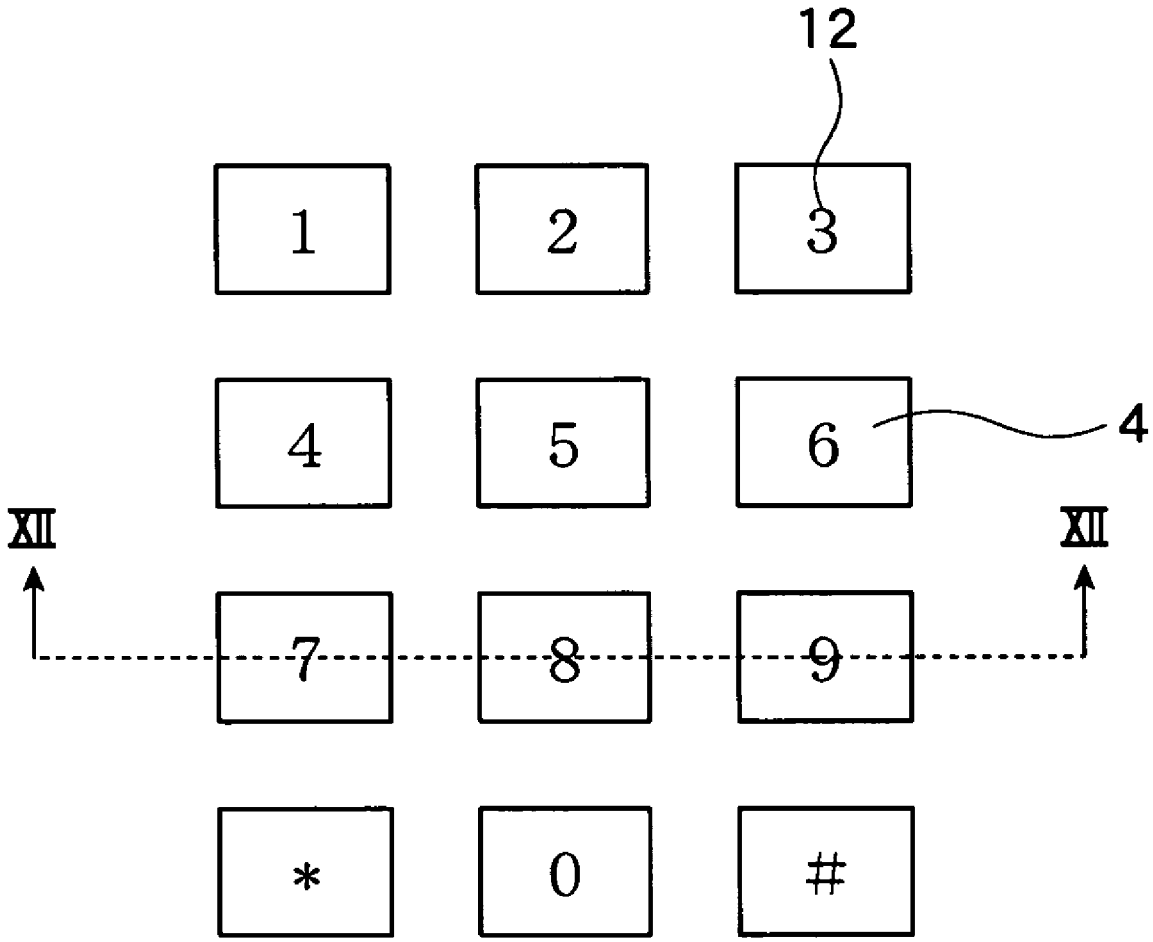
FIG. 10A is a front view of a keytop each of which is cut and separated by gate cutting from an injection molded product shown in FIG. 10B.
Figure 10B:
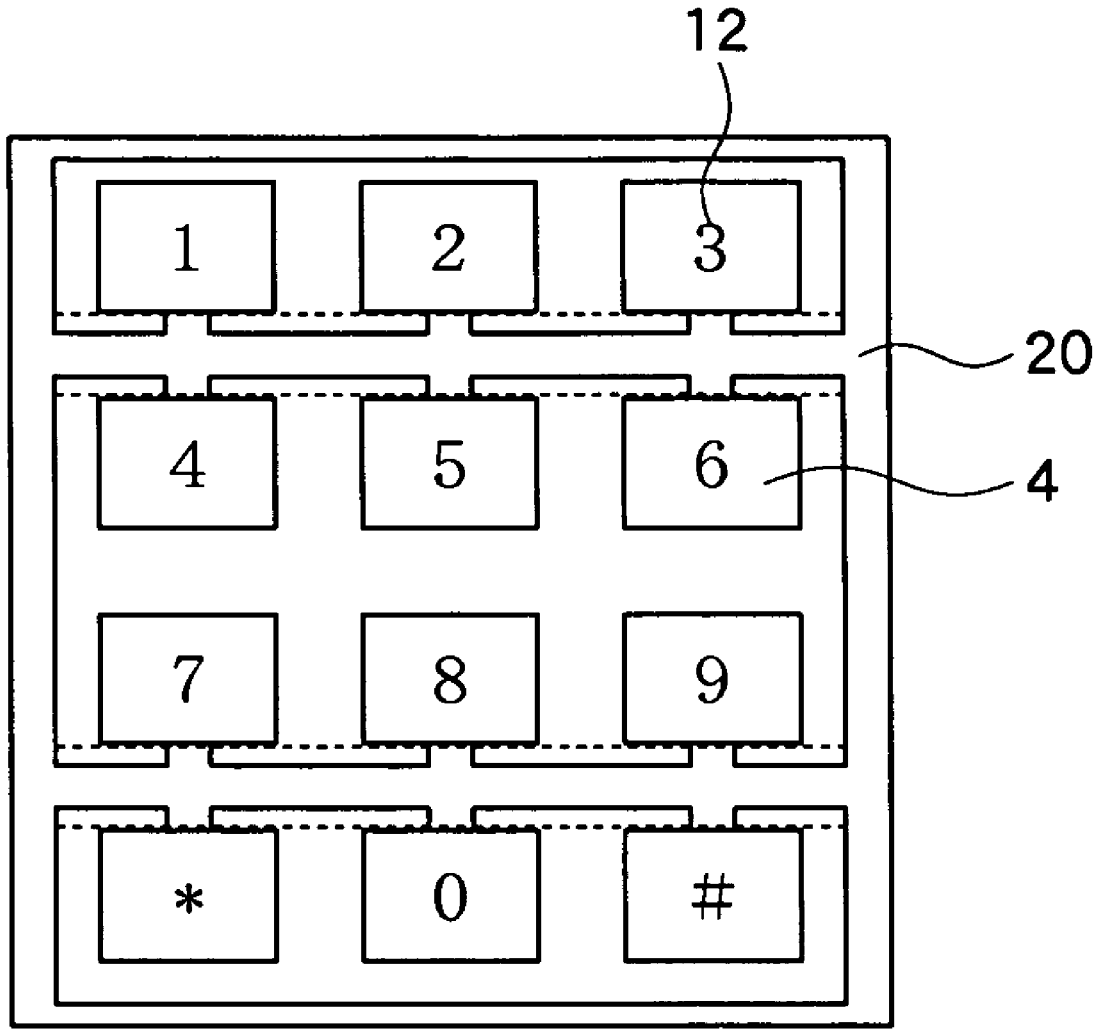
FIG. 10B is a front view of an injection-molded product from which each keytop with a character mark is not yet separated.
Figure 19:
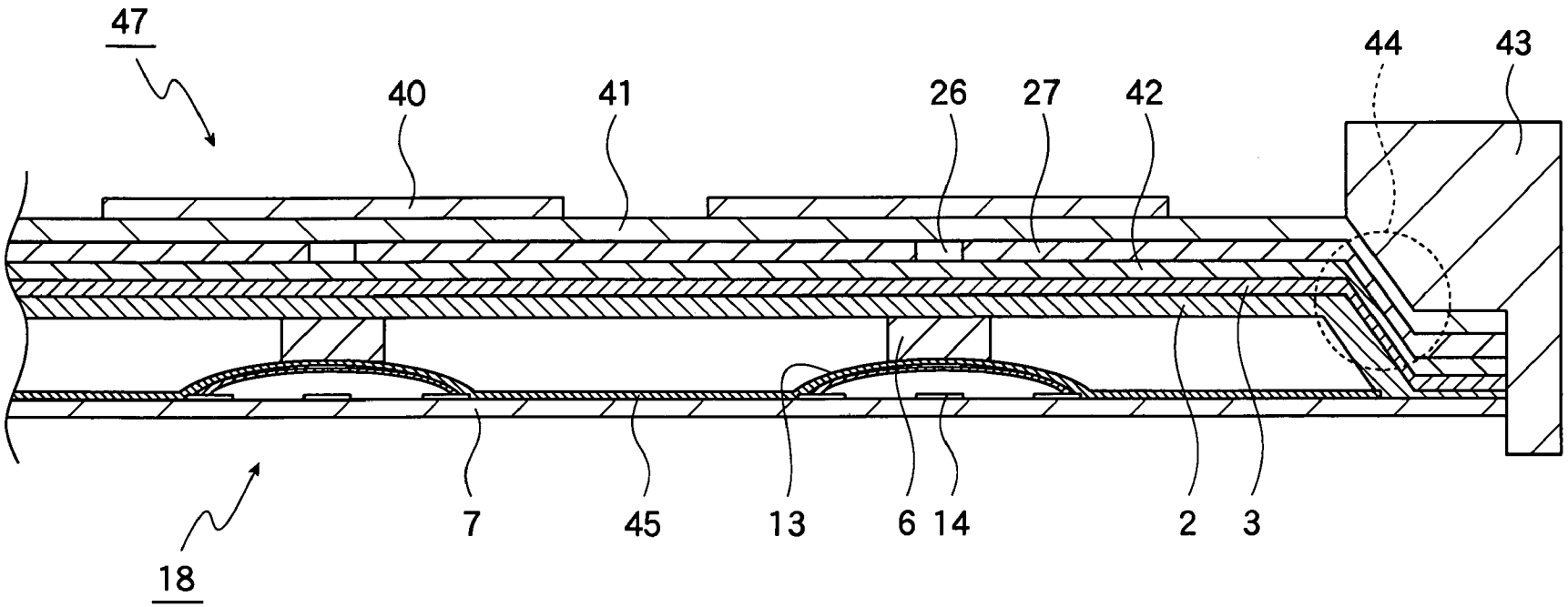
FIG. 19 is a cross sectional view seen in the cross sectional direction taken along the line passing through the keytop 40 of a still another embodiment of the push-button switch cover member of the present invention.

A member which supports a plurality of keytops is referred to as a keytop sheet. The keytop sheet may be a composite molded keytop sheet which comprises a plurality of independent keytops on a piece of sheet arranged in a surface direction (as seen in FIG. 19, the keytops 40 are arranged on the sheet 41). A plane keytop sheet in which a portion equivalents to the plurality of keytops are marked out and placed side-by-side on a piece of plane sheet, can also be used (as seen in FIGS. 6 and 9A).

As a double-stick tape used for bonding the keytop and the polyurethane elastomer, acrylic-base double-stick tape having a good bondability to polyurethane elastomer and polycarbonate resin can be preferably used. Isocyanate base adhesives have been used as adhesives for silicone rubber, but conventional silicone rubber is poor in its adhesiveness, so that pretreatment is needed when silicone rubber is used as an adherend. For example, plasma treatment or applying an amino-base silane-coupling agent as a primer was necessary to be conducted as a pretreatment. However, in the present invention, the isocyanate-base adhesives excellent in adhesiveness to both polyurethane elastomer and polycarbonate resin can be preferably used as a bonding agent for these two materials.

In addition, a binder ink can be preferably used for adhesion between the keytop and polyurethane elastomer. As an adhesive printing ink for the keytop, polycarbonate-base, acrylic-base or urethane-base ink can be preferably used when the keytop is made of polycarbonate resin, for example, SG 740 (produced by Kabushiki Kaisha Seiko Advance), Noriphan HTR (produced by PROLL KG). When the keytop is made of acrylic-base material, a polycarbonate-base, acrylic-base or urethane-base ink can be preferably used, for example, CAV Meiban (produced by Kabushiki Kaisha Seiko Advance). When the keytop is made of PET base material, a polyester-base or urethane-base ink can be preferably used, for example, 9300 HIPET (produced by Jyujo Chemical Kabushiki Kaisha). The keytop is made of stainless steel, an urethane-base or epoxy-base ink is preferably used, for example, HAC (produced by Kabushiki Kaisha Seiko Advance).

Push-button switch cover members which are produced not by the process in which the keytop is stuck to the polyurethane elastomer sheet using the double-stick tape can be made, for example, by the following process as shown in FIGS. 6 to 14 etc. The process comprises following steps:

first preparing a sheet 19 (FIG. 6) or an injection-molded item 20 (FIG. 7) as a keytop equivalent from which an independent keytop can be produced, then providing a decoration layer on each keytop equivalent, producing the keytop, wet-printing on the polyurethane elastomer sheet, and finally integrating the keytop, polyurethane elastomer sheet and silicone rubber into one body.

Figure 8:
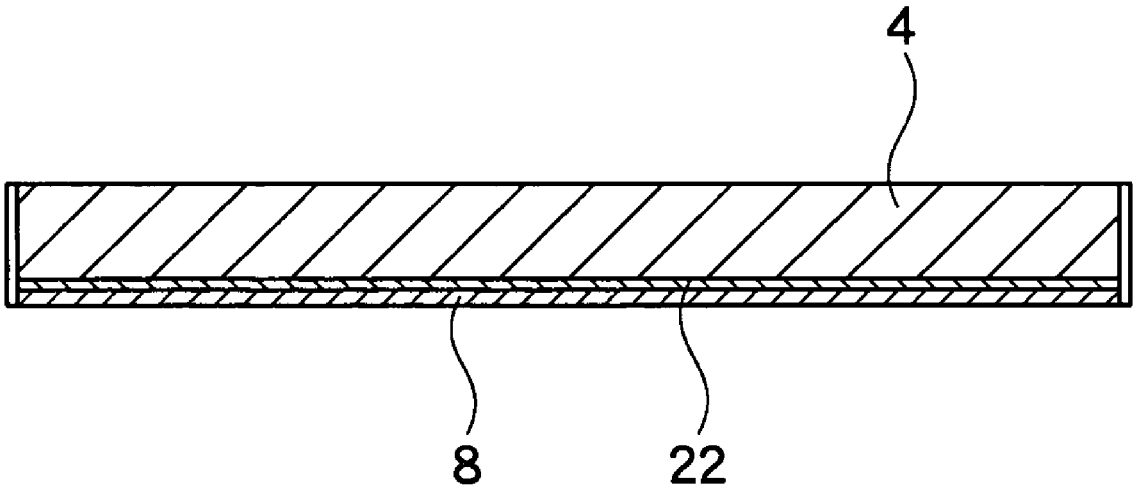
FIG. 8 is a sectional view of FIG. 6 taken along the line XIII-XIII of FIG. 6, in the case where

At the step where the decoration layer is provided (FIGS. 6 and 7), a decoration layer 22 (FIG. 8) such as characters and symbols 12 is formed at a predetermined position by a wet-printing method such as a screen printing, pad printing or inkjet printing on the keytop equivalents (on the sheet 19 or on the injection-molded items 20 to which a number of keytop-like shapes are connected). When the decoration layer is printed on the rear or lower surface, the characters are printed in the form of mirror copies (the characters are copied as if the characters are reflected in a mirror) and when printed on the top surface thereof, the characters are printed in the form of exact copies (not mirror copies). When the keytop is made of metal sheet or light-blocking (light-shielding) material, the characters and symbols are engraved like outlined characters using an etching process or laser beam irradiation and then its top surface is over-coated with transparent material. The rear or lower surface of the translucent keytop is covered by a decoration printing ink and then covered by an adhesion printing-ink layer. However, when the final layer of the decoration printing-ink layer is made of the same series of the adhesion printing-ink layer, the adhesion printing-ink layer can be omitted. FIG. 8 is a schematical sectional view taken along the line of VIII-VIII of FIG. 6 and the keytop equivalent 4, decoration layer 22 and adhesive layer 8 are shown.

Figure 11:
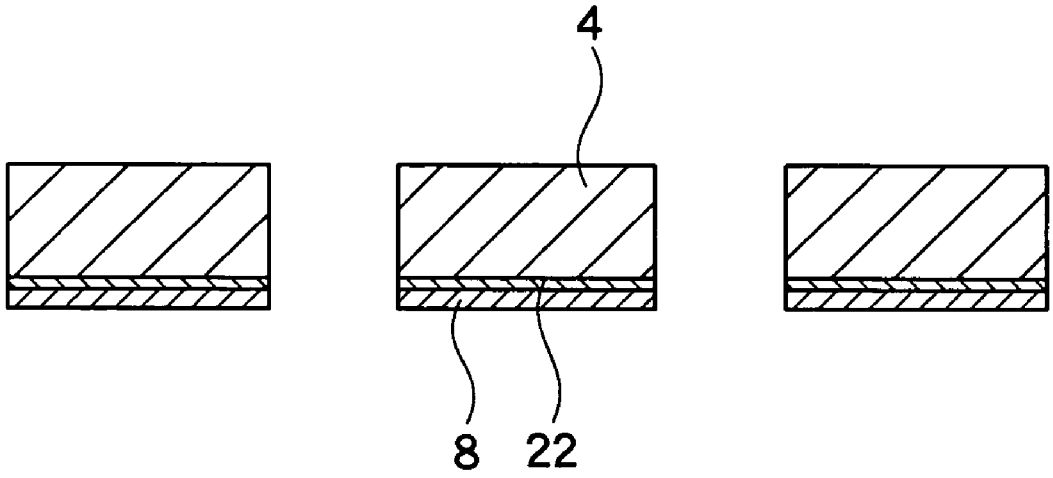
FIG. 11 is a sectional view taken along the line XII-XII of FIG. 10A.
Figure 12:
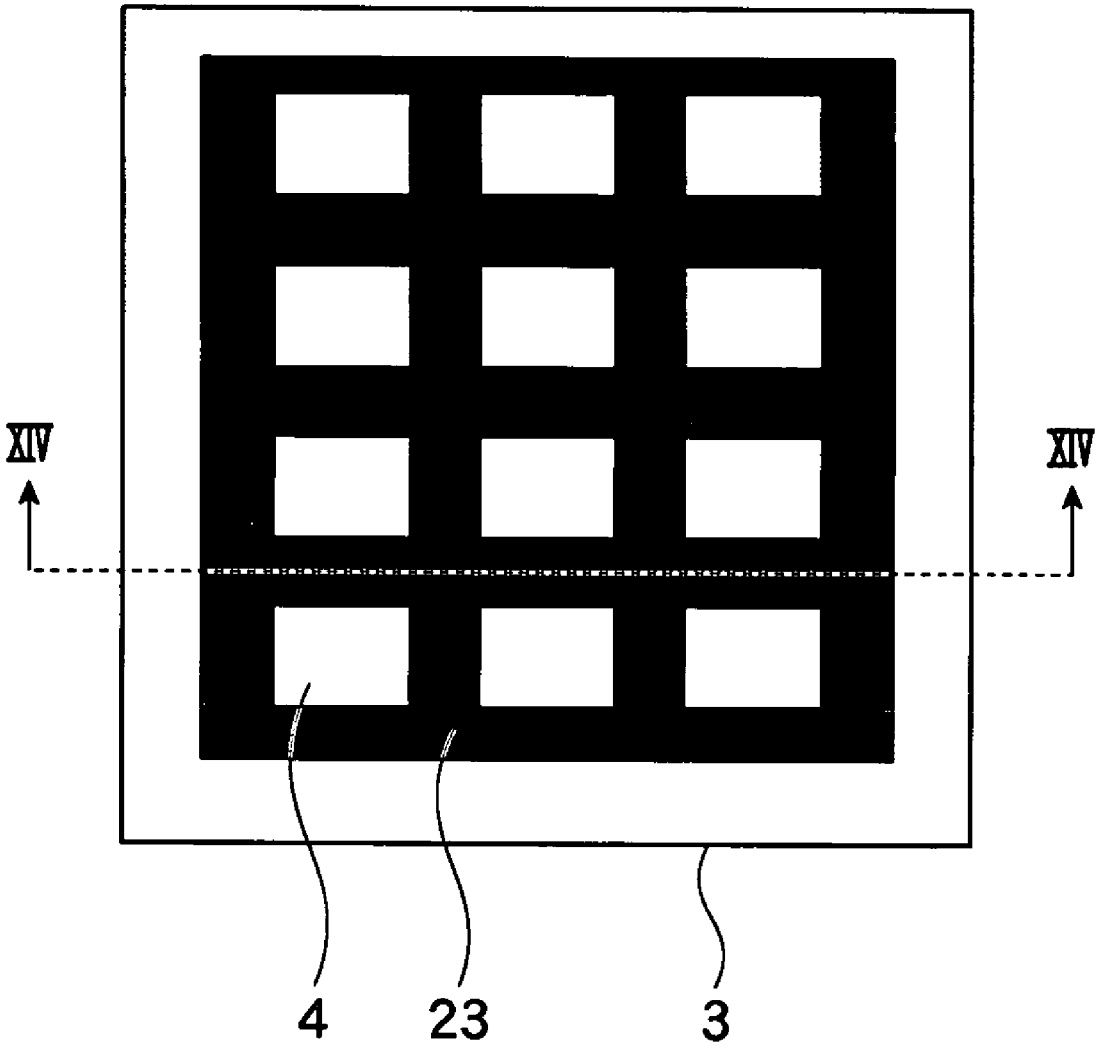
FIG. 12 is a front view of an urethane film with a light-shielding layer printed on an area other than the area corresponding to a keytop portion.

In the keytop-forming processes (FIGS. 9A, 9B, 10A and 10B), a key-like-shape punching process is carried out. When the keytop is formed to be a sheet-like shape (FIG. 9B), the outer shape of the keytop sheet is punched out to form a plane sheet-like keytop sheet. In the slit processing, a slit 21 (FIG. 9A) is formed in the sheet 19, to provide a plane sheet-type keytop sheet, too. A drawing process around the outer circumferential portion may be carried out before the punching-out process. In case of an injection molded item (FIG. 10B) to which a plurality of keytops are connected, each keytop 4 is gate cut at a gate portion to produce a single keytop 4 (see FIGS. 10A and 10B). FIG. 11 is a cross sectional view taken along the line XI-XI in FIG. 10A when the keytop 4 is made of a transparent resin material. The keytop 4, the decoration layer 22 and the adhesive layer 8 are arranged.

Figure 13:
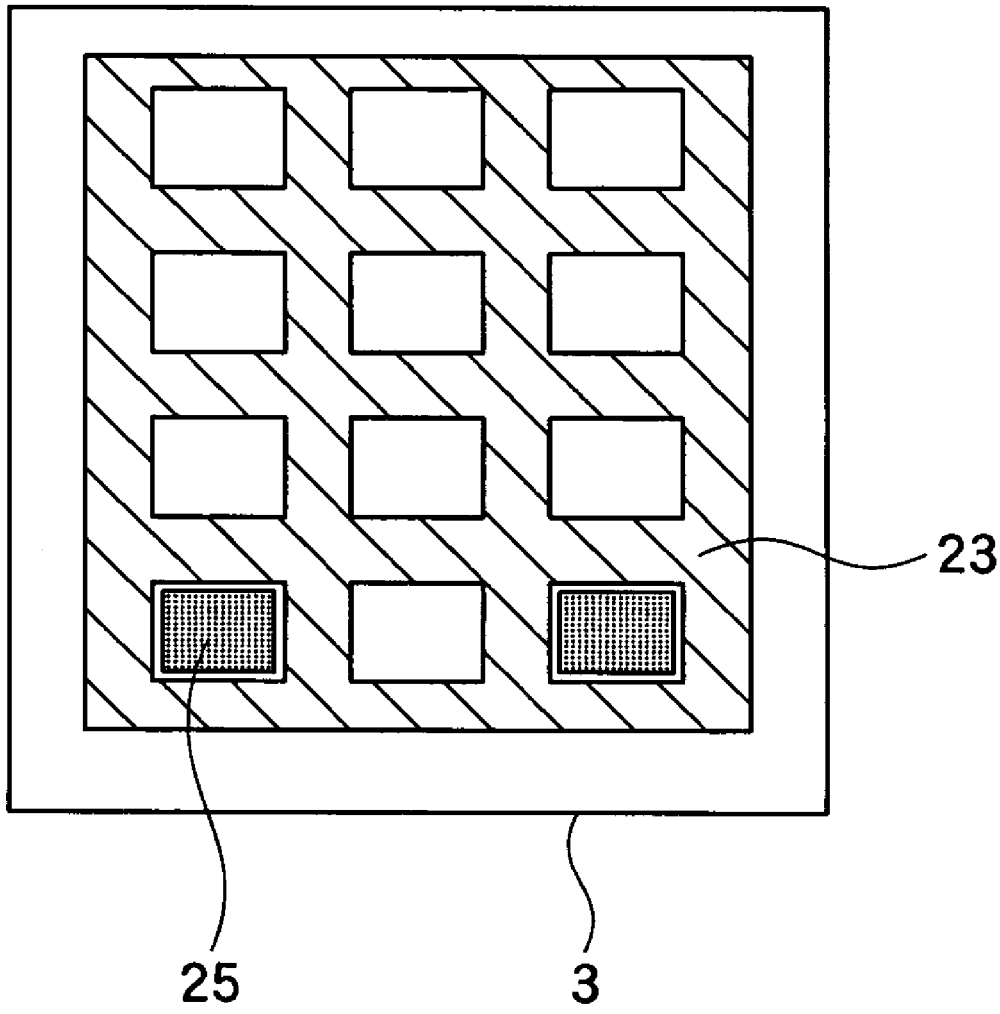
FIG. 13 is a front view of a keytop made from a metal sheet printed with colored characters.
Figure 14:
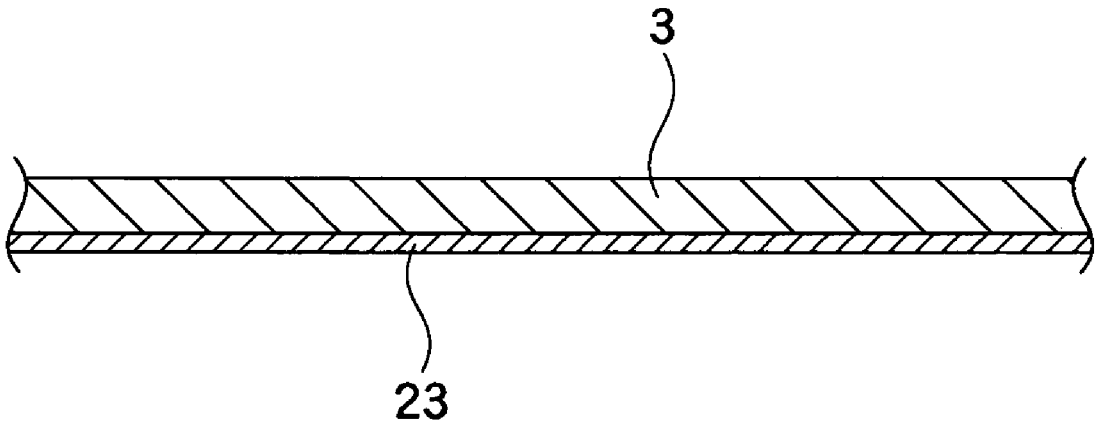
FIG. 14 is a sectional view taken along the line XIV-XIV of FIG. 12.

In the wet printing process to the polyurethane elastomer sheet 3 (FIG. 12), the light-blocking layer 23 is printed on an area other than an area corresponding to the keytop portion 4. When the metal-made keytop sheet 32 (FIG. 17) is integrated with the polyurethane elastomer sheet, a printing layer 25 is applied as a character color on an area corresponding to the etching portion of the characters and symbols etc. (see FIGS. 13 and 18). FIG. 14 is a schematic view showing a cross sectional view of the polyurethane elastomer sheet 3 taken along the line XIV-XIV in FIG. 12. The polyurethane elastomer sheet 3 and the light-blocking printing layer 23 are shown.

In the last process, the keytop, the polyurethane elastomer sheet and the silicone rubber are integrated by either one of the processes (1) or (2) mentioned below.

(1) Integral molding of the keytop, polyurethane elastomer sheet and silicone rubber: The integral molding is implemented firstly by setting the keytop and polyurethane elastomer sheet in this order into a molding die and then the silicone rubber is compression-molded on them or is injection-molded on them.

The molding is carried out at about 120° C. for 3 minutes. At this time, the adhesive layer printed on a portion corresponding to the keytop turns soft by heat and polyurethane elastomer sheet, which is also turned soft by heat are firmly attached together by an anchor effect. In addition, in the integral molding, there is a fear that warp occurs on the side where greater shrinkage occurs due to the difference in the heat shrinkability of the keytop, polyurethane elastomer sheet and silicone rubber. However, when the keytop is made of metal sheet, the warp can be suppressed by the rigidity of the keytop sheet. When resin-made keytop sheet is used, the warp can also be prevented from occurring when the keytop has a certain level of thickness (for example, more than 0.2 mm in thickness, preferably more than 0.4 mm) where a certain level of rigidity can be observed (refer to Example 4).

(2) Polyurethane elastomer sheet and silicone rubber is integrally molded and then the keytop is compression bonded under heating condition:

On the polyurethane elastomer sheet integrally bonded with the silicone rubber, the keytop on which adhesive layer is applied is arranged and placed on a pressing machine. Then a heated metal plate (at about 100° C.) is pressed onto the keytop so as to firmly attach the adhesive layer softened by the rising temperature of keytop to the polyurethane elastomer sheet by anchor effects (refer to Example 3 described later). To strengthen the adhesive bonding between the polyurethane elastomer sheet and silicone rubber, an urethane base or polycarbonate base ink is printed on the surface of the polyurethane elastomer sheet so that an adhesive stability can be further improved.

The present invention will be described in more detail below, with reference to the Examples. However, it should not be interpreted restrictively to the present invention, unless the scope of the present invention is surpassed.

Example 1

A selective-adhesive addition-curing type silicone rubber composition having an adhesiveness stronger to a polyurethane elastomer than to a molding die was made by adding 2 parts by weight of the paste "C-25A" (produced by Shin-etsu Kagaku Kogyo Kabushiki Kaisha) including an addition-reaction type platinum complex (platinum catalyst), 0.5 parts by weight of the paste "C-25B" (produced by Shin-etsu Kagaku Kogyo Kabushiki Kaisha) including a crosslinking agent for addition reaction and 1 parts by weight of platinum catalyst retarder "X-93-1242" (produced by Shin-etsu Kagaku Kogyo Kabushiki Kaisha) for controlling the curing time were added into 100 parts by weight of the silicone rubber compound "X-30-3622-U" (produced by Shin-etsu Kagaku Kogyo Kabushiki Kaisha) which includes 1 part by weight of an adhesive enhancing component and 100 parts by weight of an alkenyl-group containing addition curing type organopolysiloxane. Then, the mixture was kneaded uniformly with the two-roll mill and then sheeted (kneading and sheeting process).

Onto the addition curing type silicone rubber composition sheet having an adhesiveness stronger to the polyurethane elastomer than to the aforementioned sheeted molding die, a polyurethane elastomer sheet named "Sheedom DUS 605-CDR" (produced by Sheedom Kabushiki Kaisha) having 25 μm thickness and shore A hardness (JIS K7311) of 96 was stuck and cut into a shape of the molding die. Sticking was carried out using tackiness of an uncured silicone rubber composition without involving air bubbles (sheet-attaching and cutting process).

The attached and cut sheet in the form of an elastic keypad was placed into the molding die in such a manner that the polyurethane elastomer sheet was positioned on the elastic keypad side (the side on which the keytop was adhered or stuck), and then the compression molding was carried out in the molding die at 120° C. for 3 minutes to obtain the keypad. The keypad was then dried in a heated-air-circulating type drier at a temperature of 120° C. for 1 hour and then trimmed into the form of keypad having double layer structure of silicone rubber layer 2 and polyurethane elastomer 3, on which a plurality of keytops could be attached (curing process).

A Non-reinforced transparent polycarbonate resin named "Iupilon S-3000" (produced by Mitsubishi Engineering Plastics Kabushiki Kaisha) was put into a heated-air-circulating type drier and dried at 120° C. for 3 hours and then injection-molded into a key top 4 using a molding die heated up to a temperature of 100° C. and a cylinder heated up to a temperature of 300° C.

A double-stick tape on both sides of which was coated with an acrylic sticking agent named "HI-BON YT134-1" (produced by Hitachi Kasei Polymer Kabushiki Kaisha) was cut into a size little smaller than a bottom portion of the keytop 4. Then the keytop 4 was attached to a position, using the cut double-stick tape 5, corresponding to a position where a pushing projection for pressing a contact portion was provided on the rear side of the elastic keypad, obtaining the push button switch cover member 1.

The push-button switch cover member 1 obtained above was set in a push button switching operation portion of a cell-phone and pushing test was repeatedly conducted in comparison with a conventional push-button switch cover member produced by at first treating the elastic keypad surface with a low temperature plasma, applying a silane coupling agent thereon and then bonding the keytop thereto.

In the push-button switch cover member 1 of the present invention, the keytop 4 was only attached and fixed by the double-stick tape 5 but stripping or displacement of the keytop 4 was not observed and could be used similarly as the conventional push-button switch cover member produced through the conventional manufacturing procedures. No peeling between the polyurethane elastomer layer 3 and the silicone rubber layer 2 was observed.

Example 2

Figure 3:
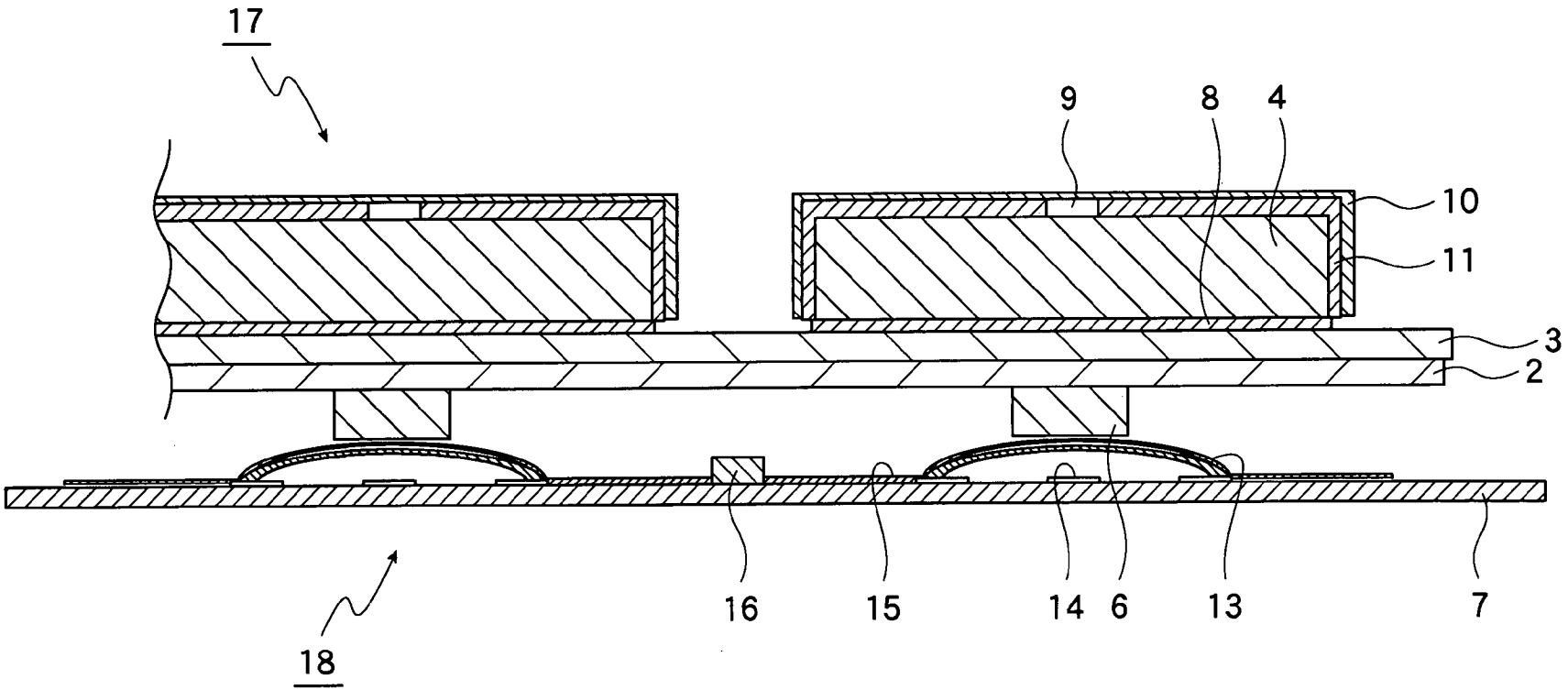
FIG. 3 is a longitudinal sectional view of a push-button switch cover member according to another embodiment of the present invention seen from the cross-sectional direction taken along a line passing through the keytop 4.
Figure 4:
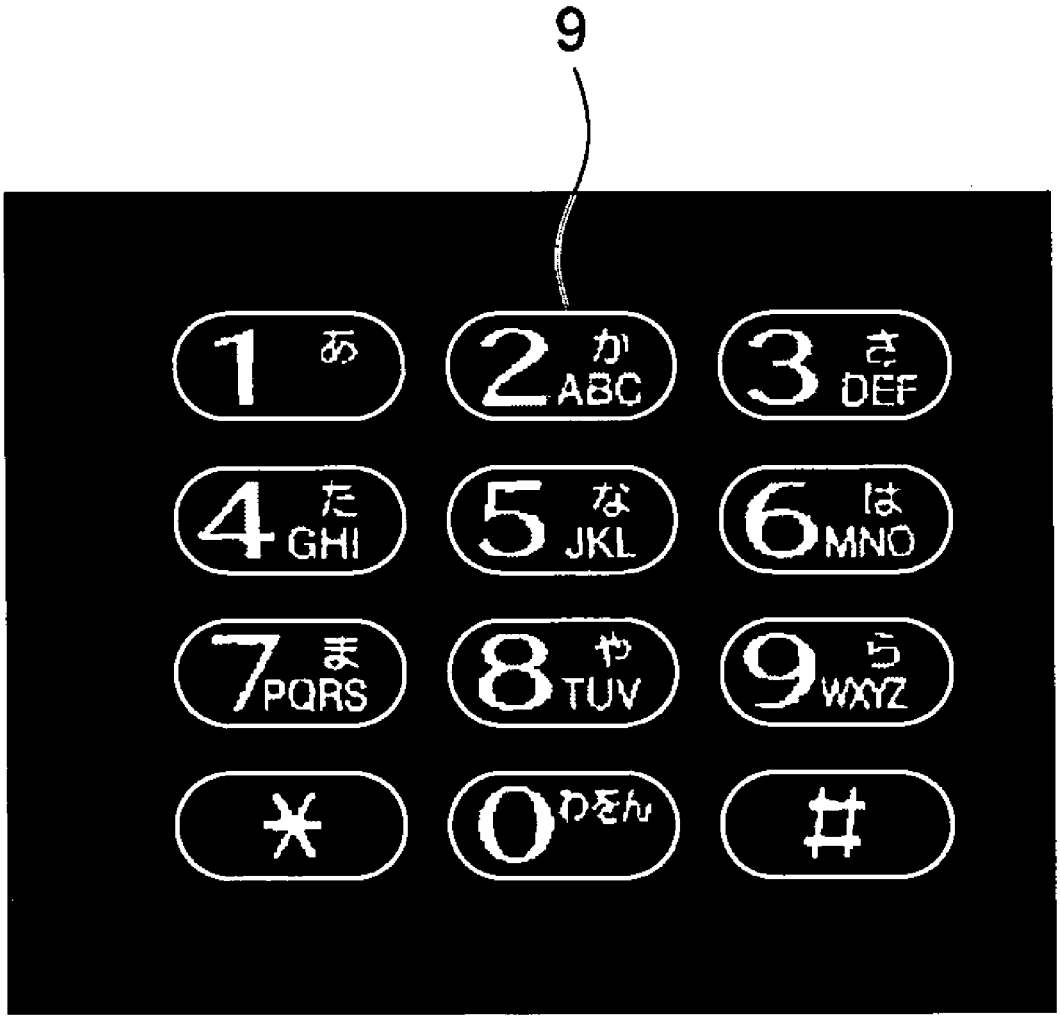
FIG. 4 is an example of characters illuminated by an internal luminescence of the push-button switch cover member of FIG. 3.

The push-button switch cover member produced in Example 2 is shown in FIG. 3. The push-button switch cover member 17 of this Example was comprised of a silicone rubber layer 2 having a pushing projection 6, a polyurethane elastomer layer 3, an adhering layer 8 and transparent resin-made keytop 4 which were laminated in this order from the bottom to the top. The keytop 4 was covered by a light-blocking decoration layer 11 except for the outlined-character portion 9 and a transparent protecting layer 10 (overcoat) was applied on the keytop 4. The push-button switch cover member 17, as shown in FIG. 3, was disposed over a switch and an illumination portion 18 including an internal light source 16 (LED in this Example), a metal dome cover sheet 15, a fixed contact 14 and a metal dome 13. FIG. 4 was an example of an internal luminescence of FIG. 3 in which characters were illuminated. The outlined characters 9 were clearly and visually recognized.

Figure 5:
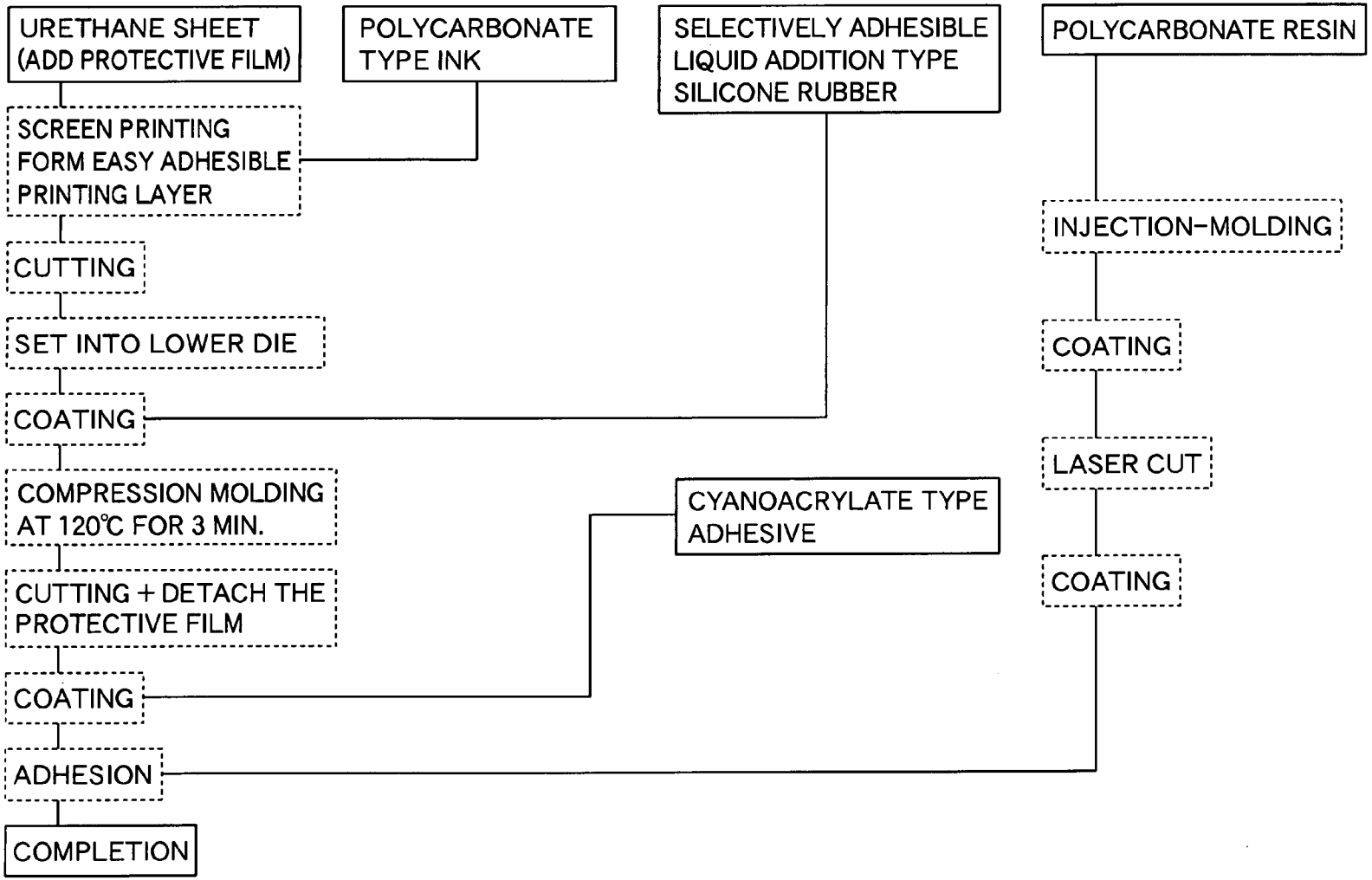
FIG. 5 is a process chart showing the manufacture of the push-button switch cover member of FIG. 3.

The push button switch cover-member 17 of this Example was produced through the steps shown in FIG. 5. On the same polyurethane elastomer sheet (except that the thickness of the sheet was formed into 50 μm and a protective film was provided on one surface thereof) a polycarbonate series ink (Noriphan HTR, produced by PROLL KG) was screen-printed, forming an easy-adhesible and printable layer (this process is not an essential one but it is adopted for further adhesiveness improvement). Then a positioning hole was formed and the outline is cut out in a predetermined shape. Next, the polyurethane elastomer sheet was set and positioned in a lower molding die with the easy-adhesible and printable layer facing up.

An uncured liquid-type silicone rubber (selectively-adhesible and addition type liquid silicone rubber X-34-1725 A/B, produced by Shin-etsu Kagaku Kogyo Kabushiki Kaisha in which a platinum catalyst and an additional reaction crosslinking agent were added. The silicone rubber composition comprises 100 parts by weight of an addition curing type organopolysiloxane composition, 1 to 100 parts by weight of reinforcing silica fine powder and 0.1 to 50 parts by weight of an organic compound or an organosilicon-compound having an epoxy equivalent of 100 to 5000 g/1 mol and at least one aromatic ring.) was applied on the surface of the polyurethane elastomer using a dispenser and then compression-molded into the shape of molding die at a temperature of 120° C. for 3 minutes.

The molded product was cut into a predetermined shape. The protecting film was removed. On the surface of polyurethane, cyanoacrylate base adhesive agent (PPX, produced by Semedain Kabushiki Kaisha) was applied using a dispenser. Immediately after the application, the keytop was pressurizedly attached to the polyurethane surface using a predetermined jig. The keytop used here was made by injection-molding a polycarbonate resin (Iupilon S-3000, Mitsubishi Engineering Plastics Kabushiki Kaisha) into a keytop shape. The surfaces except for the rear surface of the keytop was covered by a light blocking layer. The upper surface of the light-blocking layer was lazor-cut to form a desired characters or numerical characters and cut section was removed. And then the transparent protective layer was applied thereon.

Example 3

Figure 15:
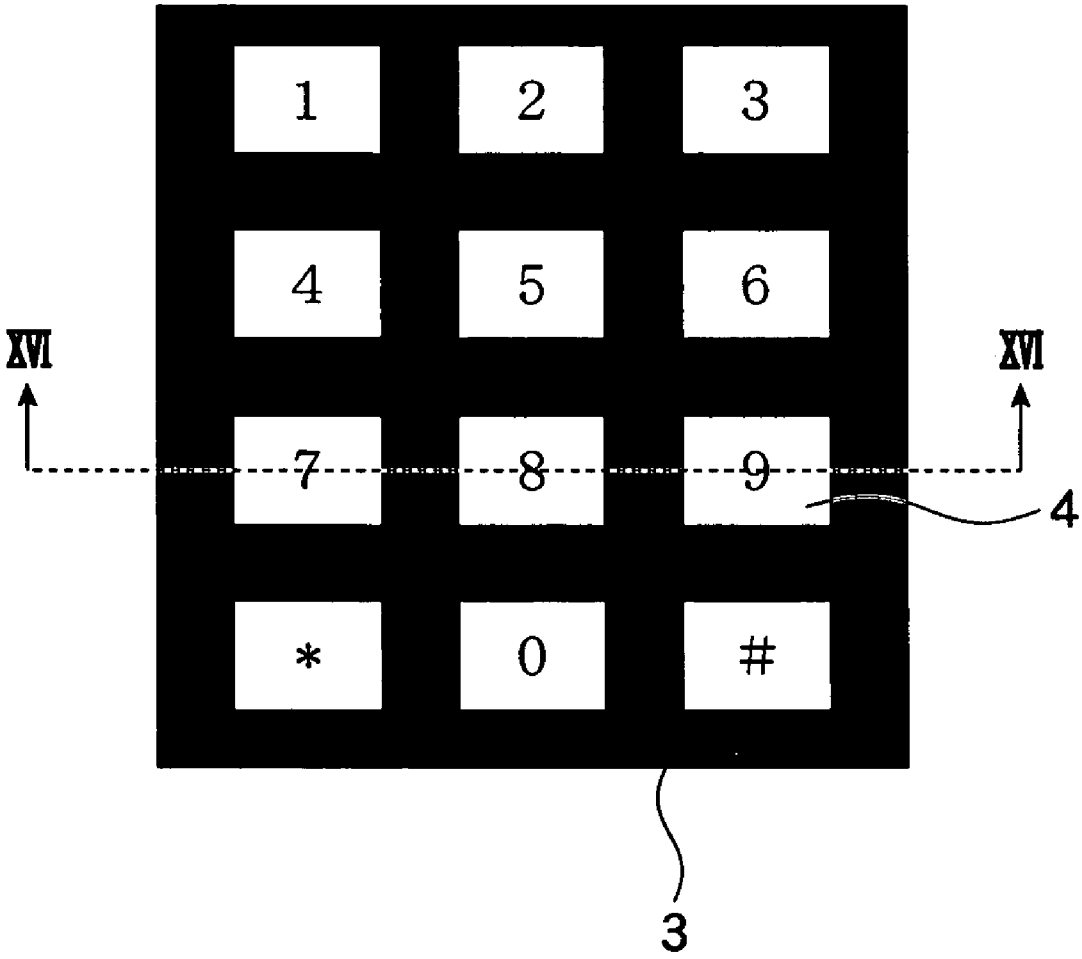
FIG. 15 is a front view of the push-button switch cover member in which a resin film or sheet shown in FIG. 9A, a urethane film and silicone rubber are formed into one body.
Figure 16:
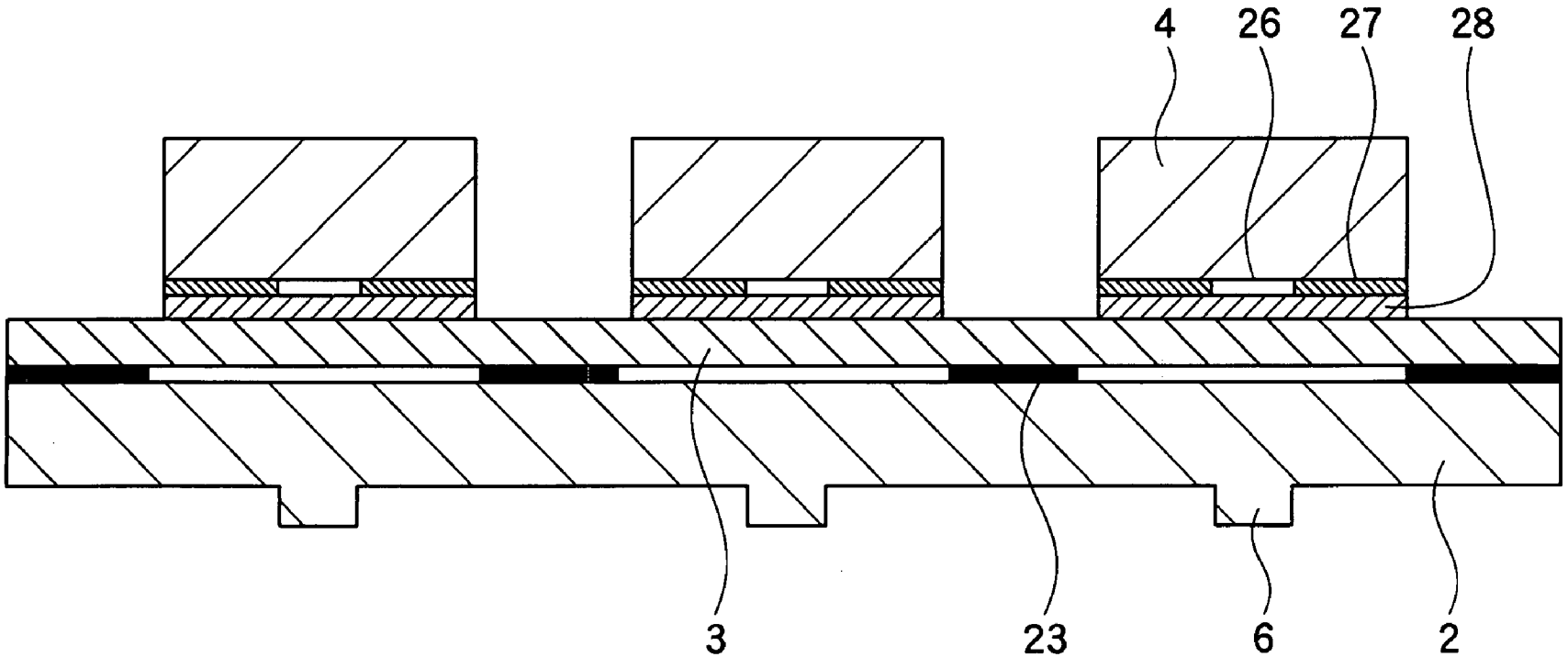
FIG. 16 is a sectional view taken along the line XVI-XVI of FIG. 15.

Example 3 is explained with reference to FIGS. 15 and 16. After a decorative printing layer (character portion) 26 such as characters or numerical characters and an adhesive layer (transparent backing print) 28 were applied on the polycarbonate film having a thickness of 0.4 mm, the polycarbonate film was cut into a keytop shape. The light-blocking printed layer 23 was applied on an area of the polyurethane elastomer layer 3 except an area corresponding to a keytop portion. And then a double layered keypad having the polyurethane elastomer sheet and the liquid silicone rubber layer was compression-molded into the shape of molding die by the same process as in the first half of the step in Example 2.

Next, on a jig engraved to be a keytop-like shape, which was set in a press, a polycarbonate keytop which is cut into a keytop shape, was set. And an integrally laminated products made from the silicone rubber layer 2 and the polyurethane elastomer sheet layer 3 was set in such a manner that polyurethane elastomer sheet side was laid over a position corresponding to the keytop. And then a metal plate heated at 100° C. was pressed to soften the adhesive ink layer 28, bonding the keytop to the polyurethane elastomer sheet 3 through heat-fusioning. A front view of the resulting push-button switch cover member is shown in FIG. 15 and a cross-sectional view taken along the line XVl-XVl is shown in FIG. 16. The push button switch cover member was composed of a silicone rubber layer 2 having a pressing projection on its rear or lowest portion, a light-blocking printed layer 23 applied to an area corresponding to an area other than the keytop portion, a polyurethane elastomer sheet 3, an adhesion layer (transparent backing-up printed layer) 28, a light-blocking decorative printed layer 27, a decorative printed layer (character-inscribed portion) 26 and the polycarbonate keytop 4 placed on the top surface of the push-button switch cover member. These members were laminated in this order.

Example 4 will be explained with reference to FIGS. 13, 17 and 18. A SUS sheet of 0.2 mm thickness was etched to form a plain sheet-type keytop sheet 32 having an outer shape, a slit 21 and an outlined character portion 30 in which a character or numerical character is formed. The outer circumference of this keytop sheet 32 was subjected to drawing process. Then, the binder (HAC, produced by Kabushiki Kaisha Seiko Advance) is printed on the rear surface of the keytop sheet 32 except for the area of the slit and the outlined characters, and the adhesive layer (printed layer) was formed. At a position corresponding to the outlined character portion of the keytop sheet which was formed of the polyurethane elastomer sheet 3 (DUS 451, produced by Sheedom Kabushiki Kaisha, 100 μm thickness), a character color layer 25 was printed. At a portion corresponding to a slit 21, the light blocking ink layer 23 was printed. A lower molding die which was engraved into a keytop-like shape, was heated up to a temperature of 120° C. The keytop sheet 32 was set into the engraved portion. Then the polyurethane elastomer film 3 was set on the keytop sheet in such a manner that the printed portions were superimposed on the corresponding portions of the keytop sheet. After the setting of the keytop sheet, the liquid silicone rubber was positioned on top of the polyurethane elastomer sheet 3. Then molding of silicone was carried out by closing the upper and lower molding die. During the silicone molding process, the printed adhesion layer 28 printed on the keytop sheet 32 became soft, and the heat fusion between the adhesion layer and the polyurethane elastomer sheet 3 began. Accordingly, the keytop sheet 32 and the polyurethane elastomer sheet 3 were formed into one body after the silicone rubber was molded.

Figure 17:
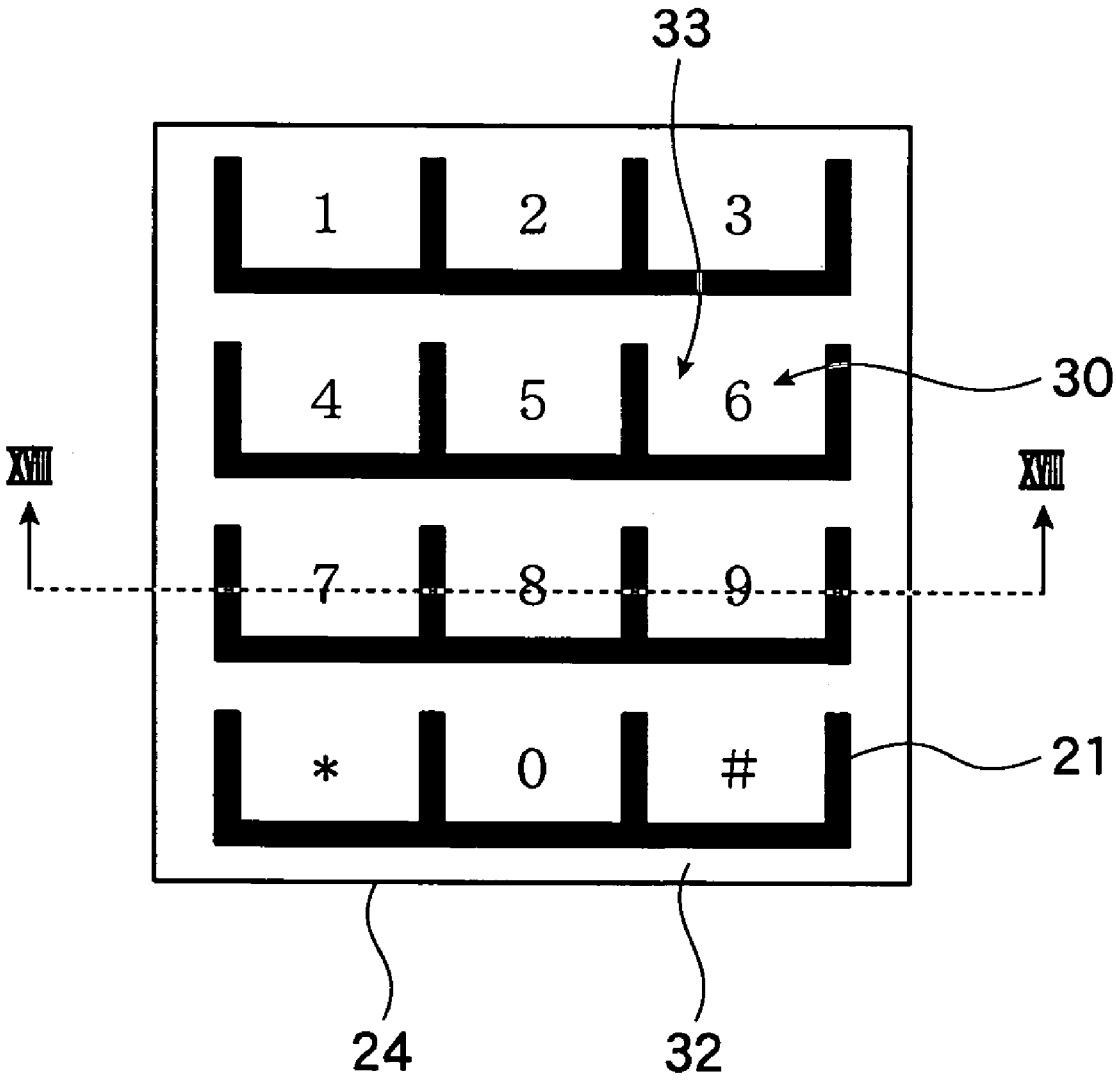
FIG. 17 is front view of the push-button switch cover member in which a connection type keytop sheet made of metal, a polyurethane sheet and a silicone rubber are formed into one body.

FIG. 17 is a front view of the resulting push-button switch cover member.

Figure 18:
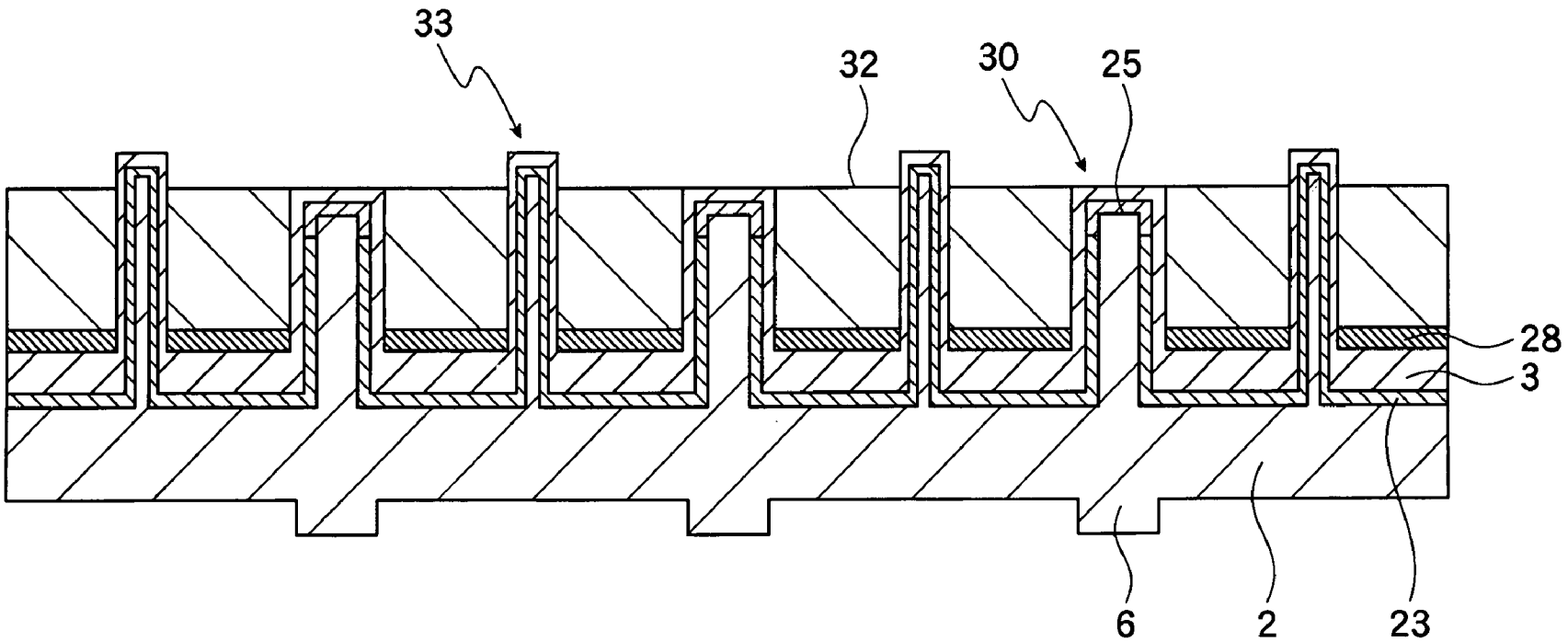
FIG. 18 is a sectional view taken along the line XVlll-XVlll of FIG. 17.

FIG. 18 is a cross-sectional view taken along the line XVlll-XVlll in FIG. 18.

On the silicone rubber layer 2 having the pressing projection 6 at the rear or lowest layer, the light-blocking printed layer 23 which is disposed at a position corresponding to the slit portion, the polyurethane elastomer sheet 3, the adhesion layer (printed layer) 28, the metal keytop 32 made of metal were arranged in this order from the bottom to the top. At a position corresponding to the outlined character 30, the silicone rubber layer 2, the transparent decorative printed layer 25 and the polyurethane elastomer sheet layer 3 were arranged in this order from the bottom to the top.

Example 5

The push button switch cover member 47 formed in Example 5 is shown in FIG. 19. The push button switch cover member 47 was composed of a silicone rubber layer 2 having a pressing projection 6 on the lower surface thereof made of selectively adhesible liquid silicone rubber, a polyurethane elastomer layer 3, an adhesive layer 42, a decorative character printed layer (character portion) 26 provided at a corresponding portion to the pushing projection 6 and a decorative base printed layer 27 provided at a portion other than a corresponding portion to the character portion, further a polycarbonate sheet 41, and an ultra violet curable resin keytop 40 provided on the upper most portion of a portion corresponding to the pressing projection 6, were laminated one-by-one in this order from the bottom to the top. In addition, a drawing processed portion 44 was provided at the outer circumference of the push-button switch cover member 17. The drawing processed portion 44 of the push-button switch cover member 47 was pressed and fixed to an upper case 43 which was used as a housing of the final product. The push-button switch cover member 47 was used after it is disposed over a switch and an illumination portion 18 which includes an internal light source (EL sheet in the present Example) 45 on the base plate 7, a fixed contact 14 and a metal dome 13 as shown in FIG. 19.

Figure 20:
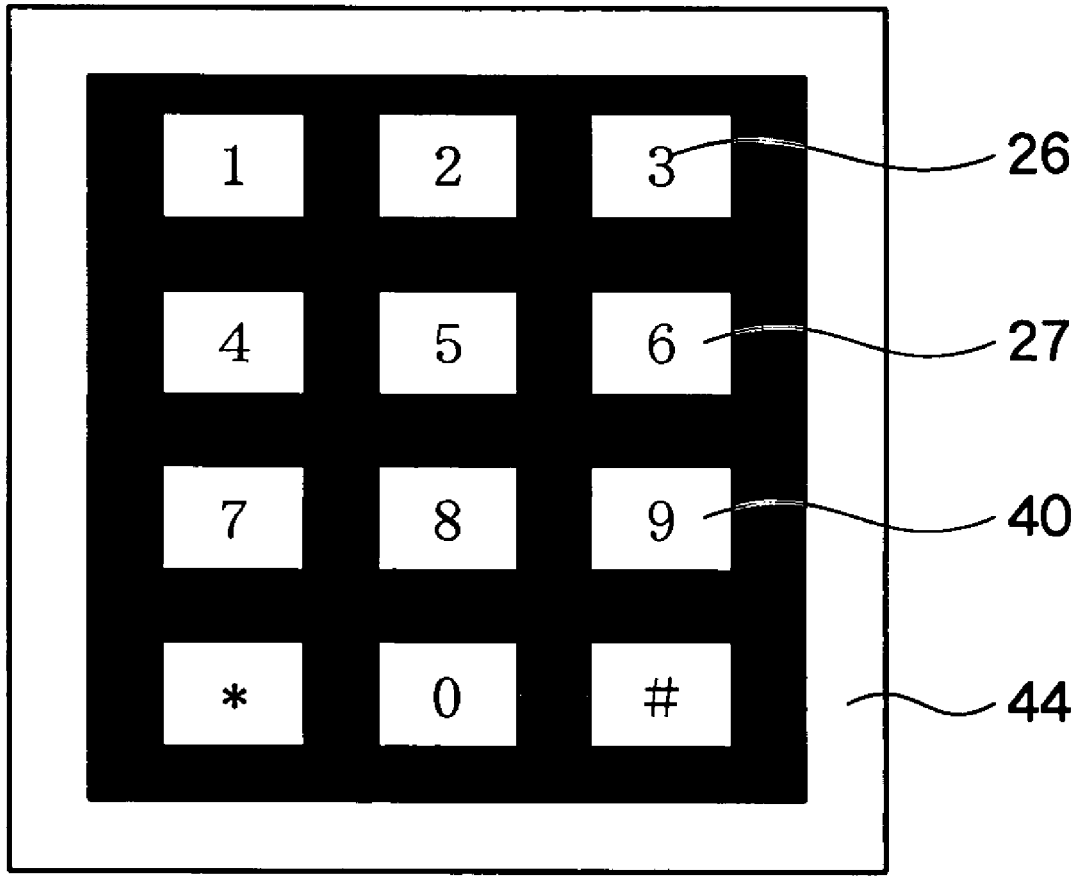
FIG. 20 is a front view showing an upper side of the keytop of the push-button switch cover member shown in FIG. 19.

FIG. 20 is an external appearance showing the upper side of FIG. 19.

Figure 21:
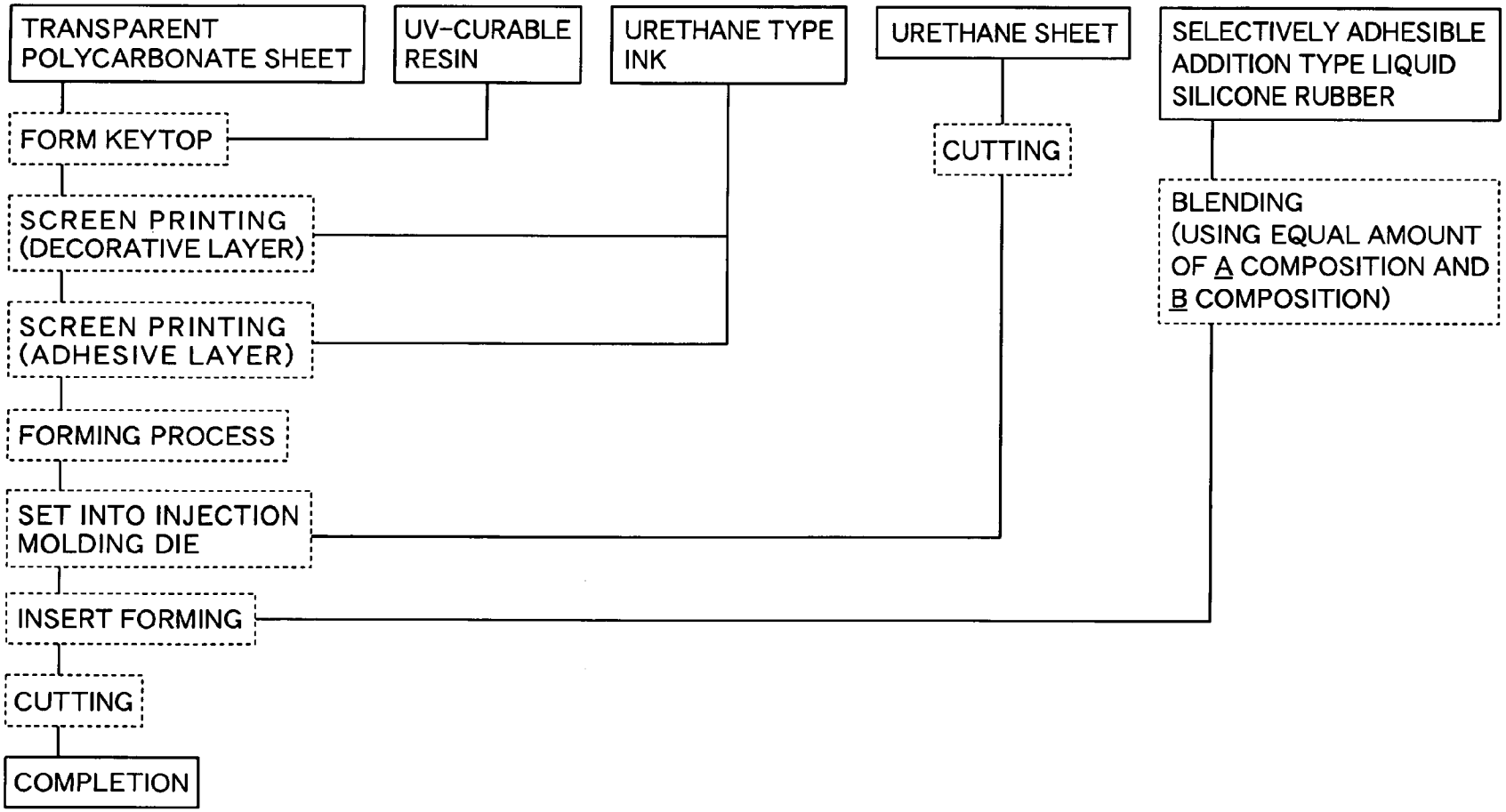
FIG. 21 is a production flow sheet of the push-button switch cover member shown in FIG. 19.

The push-button switch cover member 47 was produced according to the processes shown in FIG. 21. At first, an uncured liquid type ultra violet curable resin was poured into a U-shaped molding die engraved into a keytop shape, then a transparent polycarbonate sheet 41 (125 μm thickness, annealed), was put over the resin and exposed to an ultra violet light, to obtain a composite type keytop sheet on which a plurality of keytop projections 40 made of the ultra violet curable resin were formed and fixed to the sheet 41. On a surface opposite to the keytop, a decorative layer 27 including numerical characters, and a base color and then adhesive layer 42 were screen-printed using an urethane base ink (SG 740 produced by Kabushiki Kaisha Seiko Advance). An outer circumferential portion of the screen-printed keytop sheet was subjected to drawn processing using a molding die and then disposed into the injection-molding die with the printed layer side up. The polyurethane elastomer sheet 3 (It was used in Example 1 except that the thickness was 50 μm and a positioning hole was formed therein and the sheet was cut into a predetermined outer shape.) was inserted into a predetermined positioning pin. The mold was closed and then a selectively-adhesible liquid addition-type silicone rubber (X-34-1725A/B, produced by Shin-etsu Kagaku Kogyo Kabushiki Kaisha, component A and B were mixed in the same ratio) was injected onto the polyurethane elastomer sheet surface and insert-molded at 120° C. for 3 minutes. After the molding process, the molded product was taken out of the molding die and then subjected to debarring (or surface finishing) process, obtaining the final product of the push-button switch cover member 47.

INDUSTRIAL APPLICABILITY

The push-button switch cover member comprises an organic resin layer excellent in adhesiveness to an organic material, a silicone rubber layer excellent in adhesiveness to the organic resin and a keytop disposed on the organic resin layer. All members are excellent in adhesiveness so that some adhesive improving treatments can be skipped. Further, an adhesive durability is also excellent, so that the push button switch cover member can be preferably used for cell-phones and information terminal equipments.

REFERENCE NUMERALS

1, 17, Push-button switch cover
47 member
2 Silicone rubber layer
3 Organic resin layer or Polyurethane elastomer layer
4, 19, Keytop or Keytop sheet
32
5 Double-stick tape
6 Pushing projection
8 Adhesion layer
11 Transparent decoration layer

The invention claimed is:

1. A push-button switch cover member comprising:

a double-layered elastic keypad having an upper side and a lower side, and comprising a silicone rubber layer having a backside and an organic resin layer that adheres to an organic material;

one of a single keytop and multiple keytops attached to the elastic keypad on a mounting portion, the one of a single keytop and multiple keytops having a lower side surface; and a pushing projection for pressing a contact portion, the pushing projection being disposed on the backside of the silicone rubber layer, and at a position corresponding to the mounting portion on which the one of a single keytop and multiple keytops is attached, wherein the organic resin layer is on the upper side of the elastic keypad and the silicone rubber layer is on the lower side of the elastic keypad, wherein the silicone rubber layer is formed of a silicone rubber composition having such selective adhesiveness that the silicone rubber composition has stronger adhesiveness to the organic resin layer than to a molding die, and the organic resin layer and the silicone rubber layer are firmly adhered together in one body, wherein a character or a picture is printed on the lower side surface of the one of a single keytop and multiple keytops using a binder ink and the lower side surface of the one of a single keytop and multiple keytops is directly adhered to a predetermined position on the organic resin layer using the binder ink, and wherein each keytop of the one of a single keytop and multiple keytops is individually adhered to the organic resin layer only by the binder ink.

2. A push-button switch cover member according to claim 1, wherein the organic resin layer is a polyurethane elastomer layer.

3. A push-button switch cover member according to claim 2, wherein the polyurethane elastomer layer has a thickness between 0.01 mm to 0.5 mm.

4. A push-button switch cover member according to claim 2, wherein the polyurethane elastomer layer is formed by firmly adhering a previously shaped polyurethane elastomer sheet to the silicone rubber layer at a time when the silicone rubber layer is cured.

5. A push-button switch cover member according to claim 1, wherein the silicone rubber composition comprises 100 parts by weight of addition reaction-curable organopolysiloxane compound, 1 to 100 parts by weight of a reinforcing fine silica powder and 0.1 to 50 parts by weight of an organic compound or an organic silicon compound having 100 to 5000 g/1 mol of epoxy equivalent and at least one aromatic ring.

6. A push-button switch cover member according to claim 1, wherein the silicone rubber is a millable silicone rubber composition or a liquid silicone rubber composition.

7. A push button switch cover member according to claim 1, wherein the one of a single keptop and multiple keytops is multiple keytops that are formed into one of a plain keytop sheet and a composite moldable keytop sheet.

8. A push-button switch cover member according to claim 7, wherein the one of a plain keytop sheet and a composite moldable keytop sheet is a plain keytop sheet made of resin or metal.

9. A push-button switch member according to claim 1, wherein the lower side surface of the one of a single keytop and multiple keytops is printed using binder ink without using other adhesives.

* * * * *